US007663658B2

(12) United States Patent
Murano et al.

(10) Patent No.: US 7,663,658 B2
(45) Date of Patent: Feb. 16, 2010

(54) IMAGE FORMING APPARATUS TO CARRY OUT POSITION DETERMINATION OF A ROTATING BODY

(75) Inventors: Junichi Murano, Sayama (JP); Kazuyoshi Matsumoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 647 days.

(21) Appl. No.: 11/478,694

(22) Filed: Jul. 3, 2006

(65) Prior Publication Data

US 2007/0002122 A1 Jan. 4, 2007

(30) Foreign Application Priority Data

Jul. 4, 2005 (JP) ..... 2005-195438
Nov. 16, 2005 (JP) ..... 2005-332015

(51) Int. Cl.
*G03G 21/16* (2006.01)

(52) U.S. Cl. ..... 347/245; 347/263

(58) Field of Classification Search ..... 399/110, 399/116; 347/245, 263
See application file for complete search history.

(56) References Cited

U.S. PATENT DOCUMENTS

| | | | | |
|---|---|---|---|---|
| 6,041,203 | A | 3/2000 | Suzuki et al. | |
| 6,453,136 | B1 | 9/2002 | Yasumaru | |
| 6,725,991 | B2 | 4/2004 | Murano et al. | |
| 6,978,103 | B2 * | 12/2005 | Miura et al. | 399/116 |
| 7,106,990 | B2 * | 9/2006 | Murano et al. | 399/108 |
| 2005/0095032 | A1 | 5/2005 | Murano et al. | |

FOREIGN PATENT DOCUMENTS

| | | |
|---|---|---|
| JP | 04-229889 | 8/1992 |
| JP | 4-368963 | 12/1992 |
| JP | 8-30054 | 2/1996 |
| JP | 11-249364 | 9/1999 |
| JP | 2001-222207 | 8/2001 |
| JP | 2001-242671 | 9/2001 |
| JP | 2002-139976 | 5/2002 |
| JP | 2003-186372 | 7/2003 |
| JP | 2003-316105 | 11/2003 |
| JP | 2004-177443 | 6/2004 |
| JP | 2004-233902 | 8/2004 |

OTHER PUBLICATIONS

U.S. Appl. No. 11/617,896, filed Dec. 29, 2006, Matsumoto et al.

* cited by examiner

*Primary Examiner*—Huan H Tran
(74) *Attorney, Agent, or Firm*—Oblon, Spivak, McClelland, Maier & Neustadt, L.L.P.

(57) ABSTRACT

An image forming apparatus includes a plurality of image carrier units and a position determining unit. The image carrier units form toner images in a sequential manner, and each of the plurality of image carrier units includes an image carrier and a supporting member to support the image carrier. The position determining unit includes a holding member having a plurality of openings for receiving the supporting members of the respective image carriers and a pressure mechanism. Each of the plurality of openings has a predetermined shape to sustain a weight of a corresponding one of the plurality of image carrier units through a corresponding one of the supporting members in a vertical direction and to grip the corresponding one of the supporting members in a horizontal direction. The pressure mechanism presses the supporting members held through the plurality of openings of the holding member to fix the image carriers at respective specific positions.

13 Claims, 30 Drawing Sheets

IMAGE FORMING APPARATUS TO CARRY OUT POSITION DETERMINATION OF A ROTATING BODY

CROSS REFERENCE TO RELATED APPLICATIONS

This patent specification is based on and claims priority under 35 U.S.C. §119 of Japanese patent application, No. JP2005-195438 filed on Jul. 4, 2005 and No. JP2005-332015 filed on Nov. 16, 2005 in the Japan Patent Office, the entire contents of each are incorporated herein by reference.

BACKGROUND

1. Field of Invention

Exemplary aspects of the present invention relate to an image forming apparatus that makes use of an electrophotographic process, such as a copier, a printer, a facsimile, a plotter, or a multi-function machine having a combination of these functions, and more particularly to an image forming apparatus having a device for carrying out position determination of a rotating body.

2. Description of Related Art

Related art image forming apparatuses such as copiers, printers, facsimiles or multi-function machines having a combination of these functions use an electrophotographic process. A related-art color image forming apparatus is one of the above-mentioned image forming apparatuses. The related-art color image forming apparatus includes a plurality of image carriers for different basic colors, and particularly needs accurate positioning of each of the plurality of image carriers. Each image carrier is typically formed as a photoreceptor drum and may be assembled together with associated components into a so-called process cartridge to provide a convenient replacement in a cartridge form. That is, each of a plurality of process cartridges for different basic colors is detachably installed in a related-art color image forming apparatus. Based on such a structure, preventing a displacement of images has been a critical issue. Therefore, in an effort to address such a problem, various types of methods have been proposed and practiced according to, for example, Japanese Patent Laid-Open Application Publications, No. JP04-229889, No. JP2004-177443, No. JP10-7260, No. JP2004-233902, No. JP2001-242671, and No. JP2001-222207.

SUMMARY

In view of the foregoing, an exemplary embodiment of the present invention provides an image forming apparatus which includes a simple position determining mechanism for accurately determining positions of a plurality of image carrier units. This image forming apparatus enhances operability and reduces a cost thereof.

To address or achieve the above and/or other objects, in one example, an image forming apparatus includes an image carrier unit and a position determining unit. The image carrier unit includes an image carrier and a supporting member to support the image carrier. The image carrier unit is detachably installed in the image forming apparatus and forms a toner image on a surface of the image carrier. The position determining unit includes a holding member having an opening for receiving the supporting member of the image carrier and a pressure mechanism. The opening has a predetermined shape to sustain a weight of the image carrier unit through the supporting member in a vertical direction and to grip the supporting member in a horizontal direction. The pressure mechanism presses the supporting member held through the opening of the holding member to fix the image carrier at a specific position.

Another image forming apparatus, in one example, includes a plurality of image carrier units and a position determining unit. The plurality of image carrier units form toner images in a sequential manner. Each of the plurality of image carrier units includes an image carrier and a supporting member to support the image carrier. The position determining unit includes a holding member having a plurality of openings for receiving the supporting members of the respective image carriers, and a pressure mechanism. Each of the openings has a predetermined shape to sustain a weight of a corresponding one of the plurality of image carrier units through a corresponding one of the supporting members in a vertical direction and to grip the corresponding one of the supporting members in a horizontal direction. The pressure mechanism presses the supporting members held through the plurality of openings of the holding member to fix the image carriers at respective specific positions.

To address or achieve the above and/or other objects, in one example, a position determining apparatus for use in a host apparatus has a rotary member with an end portion supported by a supporting member. The position determining apparatus further includes a swing mechanism, a holding member and a pressure member. The swing mechanism swings between an open state and a closed state relative to the host apparatus. The holding member has an opening for allowing the supporting member supporting the rotary member to enter therethrough and holding the rotary member by sustaining a weight of the rotary member in a vertical direction and gripping the supporting member in a horizontal direction. The pressure member presses the supporting member so as to determine a position of the rotary member.

To address or achieve the above and/or other objects, in one example, a position determining apparatus for use in a host apparatus having a rotary member with an end portion supported by a supporting member includes means for swinging between an open state and a closed state relative to the host apparatus and means for holding the rotary member by sustaining a weight of the rotary member via the supporting member in a vertical direction and gripping the supporting member in an horizontal direction. The position determining apparatus further includes a pressure member configured to press the supporting member to determine a position of the rotary member.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
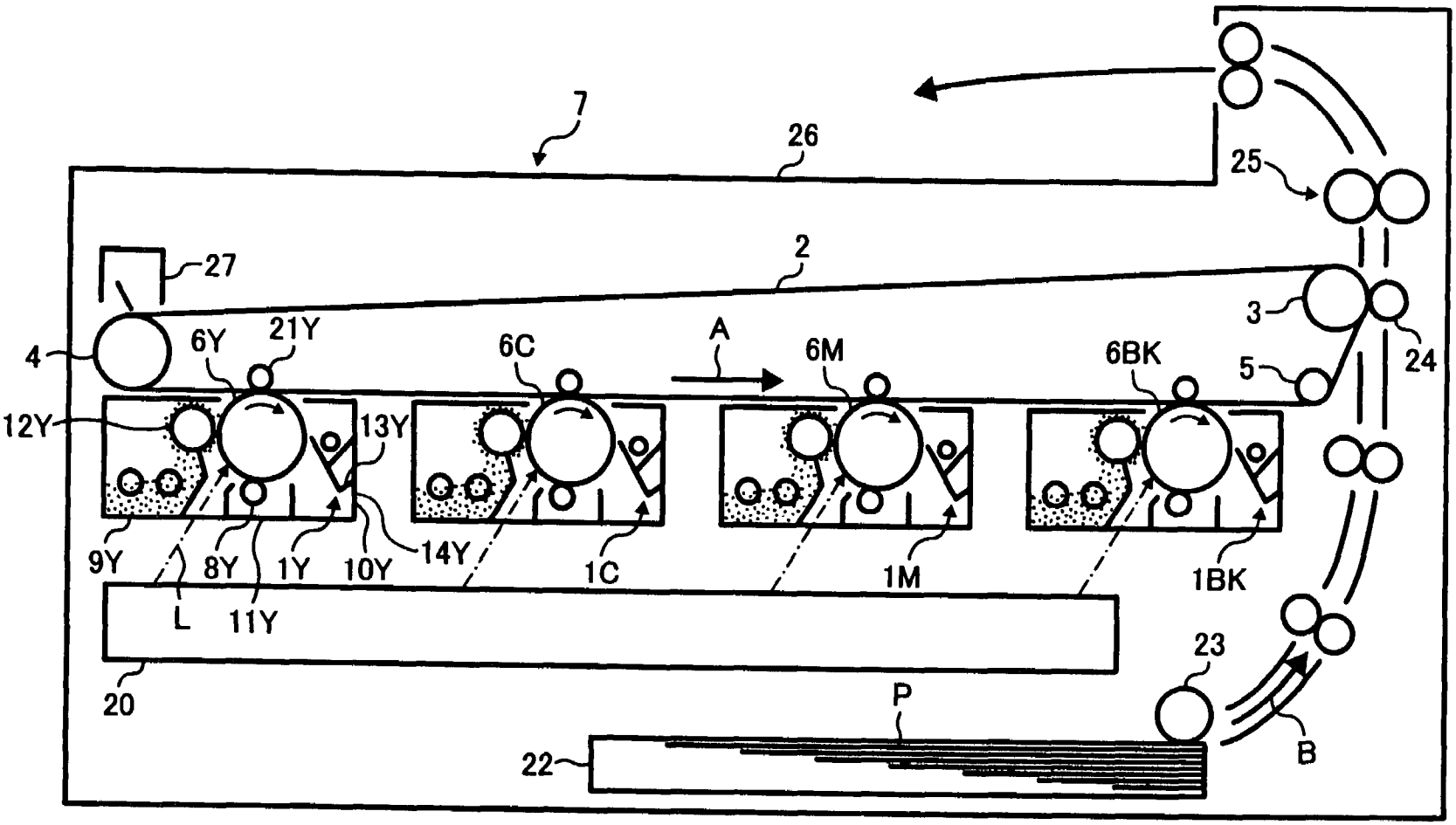
FIG. 1 is a schematic diagram of a color image forming apparatus according to an exemplary embodiment of the present invention.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. For the sake of simplicity of drawings and descriptions, the same reference numerals are given to materials and constituent parts having the same functions, and descriptions thereof will be omitted unless otherwise stated. Exemplary embodiments of the present invention are now explained below with reference to the accompanying drawings. In the later described comparative example, exemplary embodiment, and alternative example, the same reference numerals will be given to constituent elements such as parts and materials having the same functions, and the descriptions thereof will be omitted. Referring now to the drawings, wherein like reference numerals designate identical or corresponding parts throughout the several views, particularly to FIG. 1, an image forming apparatus according to an exemplary embodiment of the present invention is described.

FIG. 1 illustrates an example of a color image forming apparatus to which exemplary embodiments the present invention may be applied. With reference to FIG. 1, an structure of the image forming apparatus will be described. The image forming apparatus of FIG. 1 is a tandem-type color image forming apparatus which forms full-color images. The image forming apparatus shown in FIG. 1 includes a first process cartridge 1Y for yellow, a second process cartridge 1C for cyan, a third process cartridge 1M for magenta, and a fourth process cartridge 1BK for black mounted in a main body 7, and an intermediate transfer belt 2 serving as an intermediate transfer body disposed at a position facing the process cartridges. The intermediate transfer belt 2 is an endless belt which is laid across a plurality of rollers 3, 4 and 5 having a driving roller and a driven roller. The process cartridges 1Y, 1C, 1M and 1BK include drum-type photoreceptors (hereinafter referred to as photoreceptor drums) 6Y, 6C, 6M and 6BK, respectively, each serving as an image carrier. Toner images of different colors are sequentially formed on photoreceptor drums of respective colors, and are in turn transferred onto a predetermined position of a surface of the intermediate transfer belt 2, thereby forming a full-color toner image. Each of the process cartridges 1Y, 1C, 1M and 1BK are detachably configured with respect to the main body 7 in a longitudinal direction of not-shown rotating shafts of the photoreceptor drums 6Y, 6C, 6M and 6BK. The longitudinal direction thereof may be considered as an opening/closing direction of a later-described position determining unit.

The structures of the first process cartridge 1Y through the fourth process cartridge 1BK are similar to each other, and the structures in which toner images formed on the photoreceptor drums 6Y, 6C, 6M and 6BK are transferred onto the intermediate transfer belt 2 are also similar to each other, except for colors of toner images. Thus, descriptions will be given of the structure of the first process cartridge 1Y and the structure in which the toner image on the photoreceptor drum 6Y is transferred onto the intermediate transfer belt 2 as a representative example herein. Descriptions of the structure of other process cartridges and the transfer process of other photoreceptors are omitted. For the sake of simplicity, in each drawing subsequent to FIG. 2, alphabetic characters indicating colors are provided only to the process cartridges, photoreceptor drums and cartridge cases, and are omitted regarding other constituent parts.

Figure 2:
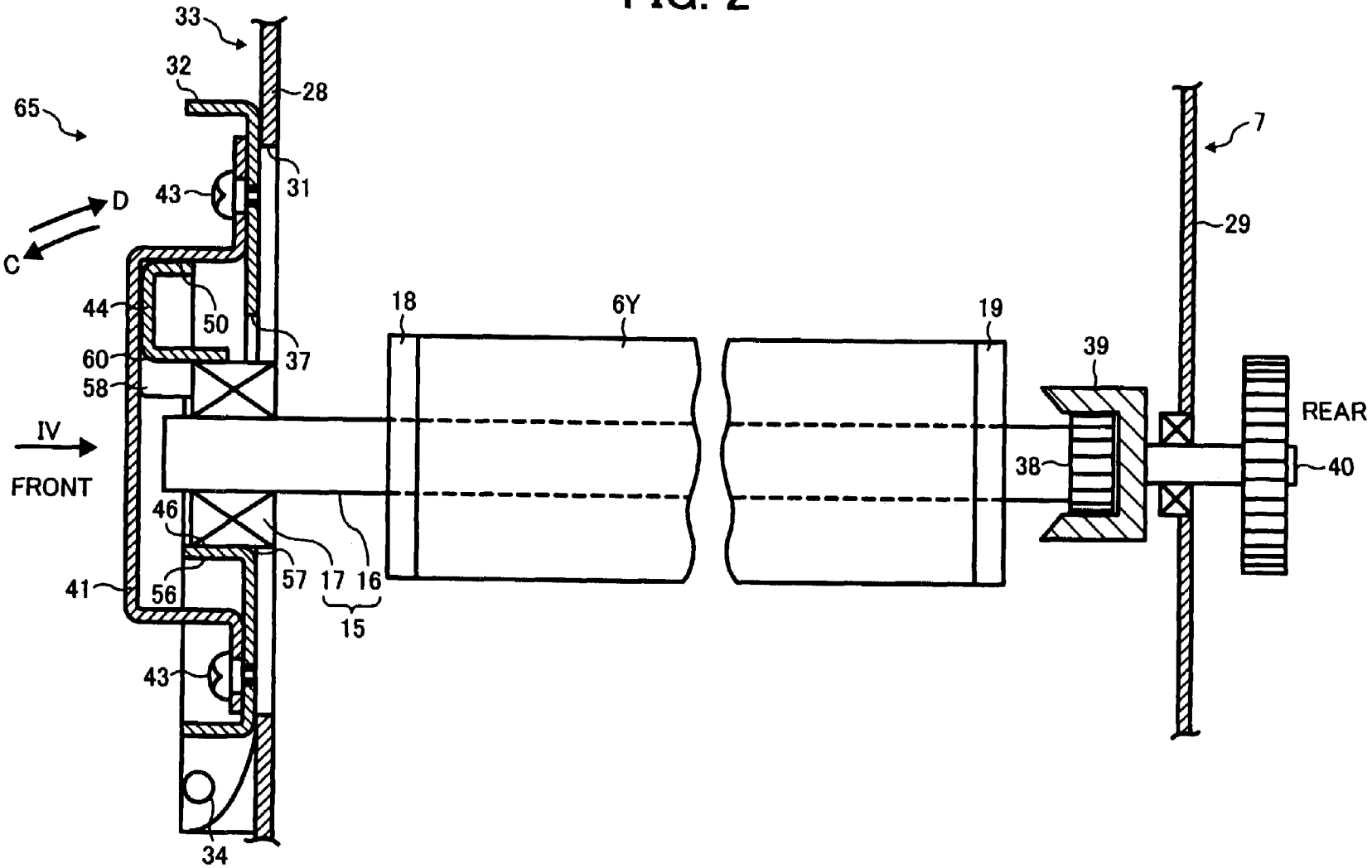
FIG. 2 is a cross-sectional view of a comparative structure for positioning a photoreceptor drum in the color image forming apparatus.
Figure 3:
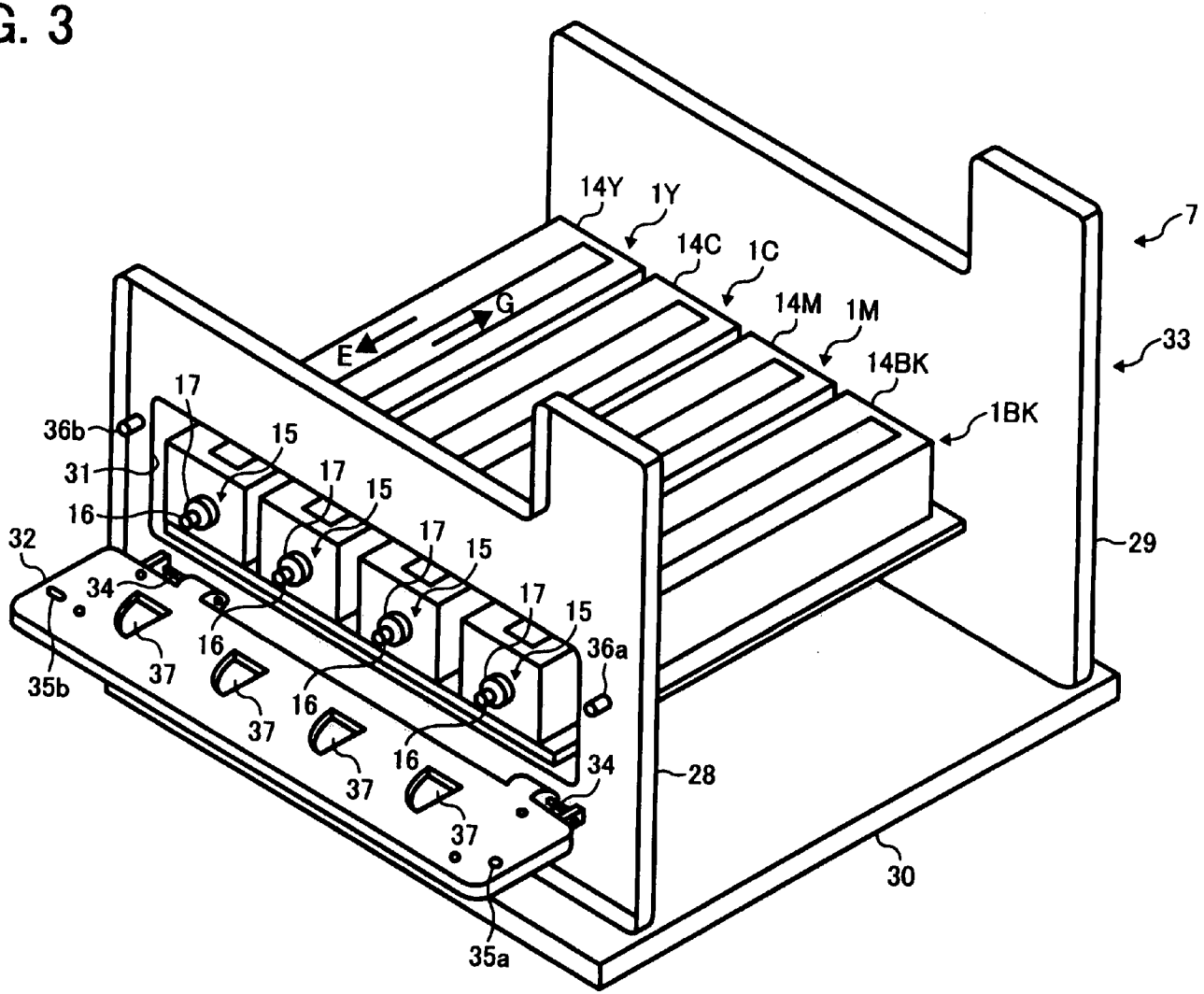
FIG. 3 is a perspective view illustrating a frame of the color image forming apparatus, a plurality of process cartridges, and a position determination holder according to the comparative structure of FIG. 2.

The first process cartridge 1Y includes a charging apparatus 11Y which includes a charging roller 8Y and so forth disposed around the photoreceptor drum 6Y, a developing apparatus 9Y which includes a developing roller 12Y and so forth, and a cleaning apparatus 10Y which includes a cleaning blade 13Y and so forth. A cartridge case 14Y, which is a common unit case, constitutes each of the cases for the apparatuses 11Y, 9Y and 10Y. FIG. 2 is a partial cross sectional view illustrating the photoreceptor drum 6Y of the process cartridge 1Y and an image carrier supporting member 15 supporting the photoreceptor drum 6Y. Constituent elements other than the process cartridge 1Y are omitted in FIG. 2. The image carrier supporting member 15 shown therein, also as shown in FIG. 3, includes a supporting shaft 16 serving as a rotating shaft and a shaft bearing 17 formed of, for example, a ball bearing mounted on the supporting shaft 16. The photoreceptor drum 6Y is fixed to the supporting shaft 16 through flanges 18 and 19 which are fixed to both ends of the photoreceptor drum 6Y. The supporting shaft 16 is rotatively mounted to the cartridge case 14Y shown in FIG. 1, through a not-shown shaft bearing.

When an image forming operation is initiated, the photoreceptor drum 6Y is rotatively driven in a clockwise direction shown in FIG. 1, and the intermediate transfer belt 2 is rotatively driven in the arrow A-direction. At this time, the charging roller 8Y of the charging apparatus 11Y rotates contacting the surface of the photoreceptor drum 6Y, thereby charging the photoreceptor drum 6Y with a predetermined charge. A modulated laser beam emitted from an exposure apparatus 20, which is a separate body from the process cartridge 1Y shown in FIG. 1, is irradiated onto the photoreceptor drum 6Y after being charged, thereby forming an electrostatic latent image on the photoreceptor drum 6Y.

The developing roller 12Y of the developing apparatus 9Y is rotatively driven in a counterclockwise direction shown in FIG. 1, and a dry-type developer is carried onto the developing roller 12Y. The yellow toner in the developer is electrostatically transferred and adhered to the electrostatic latent image formed on the photoreceptor drum 6Y, and the electrostatic latent image becomes a visible image as a yellow toner image. A primary transfer roller 21Y serving as a primary transfer mechanism is disposed across from the process cartridge 1Y, having the intermediate transfer belt 2 therebetween. The toner image formed on the photoreceptor drum 6Y is transferred to the intermediate transfer belt 2 by the effect of the primary transfer roller 21Y. Transfer residual toner adhered to the photoreceptor drum 6Y after the toner image is transferred is swept and removed from the surface of the photoreceptor surface by a cleaning blade 13Y of the cleaning apparatus 10Y.

Similarly to the above-described processes, a cyan toner image, a magenta toner image and a black toner image are formed on each of the photoreceptor drums 6C, 6M and 6BK of the second through fourth process cartridges 1C, 1M and 1BK, respectively. The toner images thereof are sequentially transferred onto the intermediate transfer belt 2 on which the yellow toner image has been transferred.

In the meantime, as shown in FIG. 1, at the bottom part of the image forming apparatus main body 7 is disposed a paper feed cassette 22 which stores transfer paper P as an example of a sheet-type recording medium. The top sheet of the transfer paper P in the paper feed cassette 22 is carried by the rotation of a paper feed roller 23 in the arrow B-direction. The transfer paper P which has been carried is conveyed between the intermediate transfer belt 2 and a secondary transfer roller 24 serving as a secondary transfer mechanism disposed across from the intermediate transfer belt 2. According to the secondary transfer roller 24, the toner image on the intermediate transfer belt 2 is transferred onto the transfer paper P. The recording medium, on which the toner image is transferred, is conveyed further upward passing a fixing unit 25. At this time, the toner image on the recording medium is fixed by the effect of heat and pressure. The recording medium which has passed the fixing unit 25 is ejected onto a paper ejecting part 26 disposed in the upper portion of the image forming apparatus main body 7. Transfer residual toner adhered to the intermediate transfer belt 2 after the toner image is transferred is removed by a cleaning unit 27 for the intermediate transfer belt 2.

Next, a detailed description will be given of the structure and operation of position determination when the process cartridges 1Y through 1BK are mounted in the image forming apparatus main body 7. As later described, the exemplary embodiment of the present invention is a position determination structure in which some enhancements are made to a position determination structure shown in FIGS. 2 and 7 and disclosed in Japanese Application No. JP2005-077128 (hereinafter referred to as comparative example).

A letter symbol F in FIG. 2 denotes a front side of the image forming apparatus, and a letter symbol R denotes a rear side of the image forming apparatus. As later described, the process cartridge 1Y and other process cartridges 1C, 1M and 1BK are detachably mounted in the image forming apparatus main body 7 in an anteroposterior direction of the process cartridges, that is, in a longitudinal direction of the supporting shaft 16. A frame 33, which constitutes the image forming apparatus main body 7, includes a front plate 28 disposed at the front of the frame 33, a rear plate 29 disposed at the rear as shown in FIG. 3 and a bottom plate 30 to which the front plate 28 and the rear plate 29 are attached.

An opening 31 formed in the front plate 28 of the image forming apparatus 7, as shown in FIGS. 2 and 3, is normally covered with a position determining unit 65 for determining positions. The position determining unit 65 is openable and closable, and is configured to attach and detach each of the process cartridges 1Y, 1C, 1M and 1BK through each respective image carrier supporting member 15. The position determining unit 65, as shown in FIGS. 2 and 4 through 7, mainly includes a single position determination holder 32 including two faces 45 and 46, and a later-described pressure mechanism. The faces 45 and 46 serving as a holding portion are formed in mounting holes 37 which hold each image carrier supporting member 15, when the position determining unit 65 is closed relative to the opening 31 of the front plate 28. The pressure mechanism is configured to determine a position by pressing each image carrier supporting member 15 held by the faces 45 and 46. A not-shown exterior cover and a not-shown front cover supported by the exterior cover are positioned around the frame 33 and the position determination holder 32.

As shown in FIGS. 2 and 3, the position determination holder 32 is held on the front plate 28 by a pair of hinge pins 34 such that it is pivotally movable in the arrows C- and D-directions within a predetermined angle. In other words, the position determination holder 32 is swingablly as well as openably/closably mounted, and is normally in a closed position shown in FIG. 2.

When the position determination holder 32 is in the closed position, a position determining hole 35*a* formed in the position determination holder 32 is fitted with a position determining pin 36*a* which is provided in the front plate 28 in a protruding manner, and a position determining hole 35*b* formed in the position determination holder 32 is fitted with a position determining pin 36*b* so that the position of the position determination holder 32 relative to the frame 33 of the image forming apparatus main body 7 is determined. The position of the position determination holder 32 at this time is the predetermined mounting position determined relative to the frame 33. In such a manner, the position determination holder 32 is positioned at the predetermined mounting position with respect to the frame 33 of the image forming apparatus main body 7, and is openably and closably mounted.

As illustrated in FIG. 3, when mounting holes 37 are formed corresponding to each image carrier supporting member 15 in the position determination holder 32, and the position determination holder 32 is in a closed position indicated in FIG. 2, that is, at the predetermined mounting position, a front portion of each image carrier supporting member 15, that is, the shaft bearing 17 in this example, is inserted into each mounting hole 37 and held so that the front portion of each image carrier supporting member 15 is positioned relative to the position determination holder 32, as described later. In such a manner, the mounting holes 37, into which each image carrier supporting member 15 is inserted and held, are formed in the position determination holder 32 in a state where the position determination holder 32 is mounted at the mounting position.

As illustrated in FIG. 2, an image carrier gear 38 is fixed on the back end portion of the supporting shaft 16 which supports the photoreceptor drum 6Y of the process cartridge 1Y. On the rear panel 29, the image carrier gear 38 and a shaft 40 of a detachable cup-shaped gear 39 are rotatively supported, and the image carrier gear 38 is engaged with the cup-shaped gear 39 in the state illustrated in FIG. 2. Accordingly, the position of the back end portion of the supporting shaft 16 is determined relative to the rear plate 29 in the longitudinal direction of the supporting shaft 16. At the front and rear sides of the cartridge case 14Y are provided not-shown pins in a protruding manner for stopping rotation. The pins are fitted in not-shown holes formed in the position determination holder 32 and the rear plate 29, thereby preventing the process cartridge 14Y from rotating around the supporting shaft 16.

The shaft 40 is rotatively driven by a not-shown motor, and rotation thereof is transmitted to the supporting shaft 16 through the gears 38 and 39 so that the photoreceptor drum 6Y is rotatively driven as described above. Since the front portion of the supporting shaft 16 is held in the mounting hole 37 of the position determination holder 32 through the shaft bearing 17, the supporting shaft 16 may rotate without any difficulty. The back end portion of each supporting shaft 16 of other process cartridges 1C, 1M and 1BK is positioned on the rear plate 29 in the same manner as described above. Furthermore, each supporting shaft 16 and the photoreceptor drums 6C, 6M and 6BK are rotatively driven in the same manner as described above.

In a state where the operation of the motor is stopped, when a not-shown front door is opened, and in the meantime the position determination holder 32 is pivotally moved to an open position shown in FIG. 3, the opening 31 is opened. When pulling the process cartridge 1Y in the frontal direction indicated by an arrow E, the process cartridge 1Y is guided by a guide rail which configures a not-shown attachable/detachable mechanism, and is pulled out in the frontal direction. On the other hand, when pushing the process cartridge 1Y in the rearward direction indicated by an arrow G, the process cartridge 1Y is guided by the guide rail and is pushed in the rearward direction so that the image carrier gear 38 is engaged with the cup-shaped gear 39 as shown in FIG. 2. The back end of the supporting shaft 16 is positioned with respect to the frame 33. Subsequently, the position determination holder 32 is swingablly moved to the closed position indicated in FIG. 2 to be positioned with respect to the front plate 28. In this state, as described later, the front portion of the supporting shaft 16 is positioned with respect to the frame 33. Subsequently, by closing the front door, the image forming operation may be initiated. Other process cartridges 1C, 1M and 1BK may also be attached/detached with respect to the image forming apparatus main body 7 in the same manner.

Figure 4:
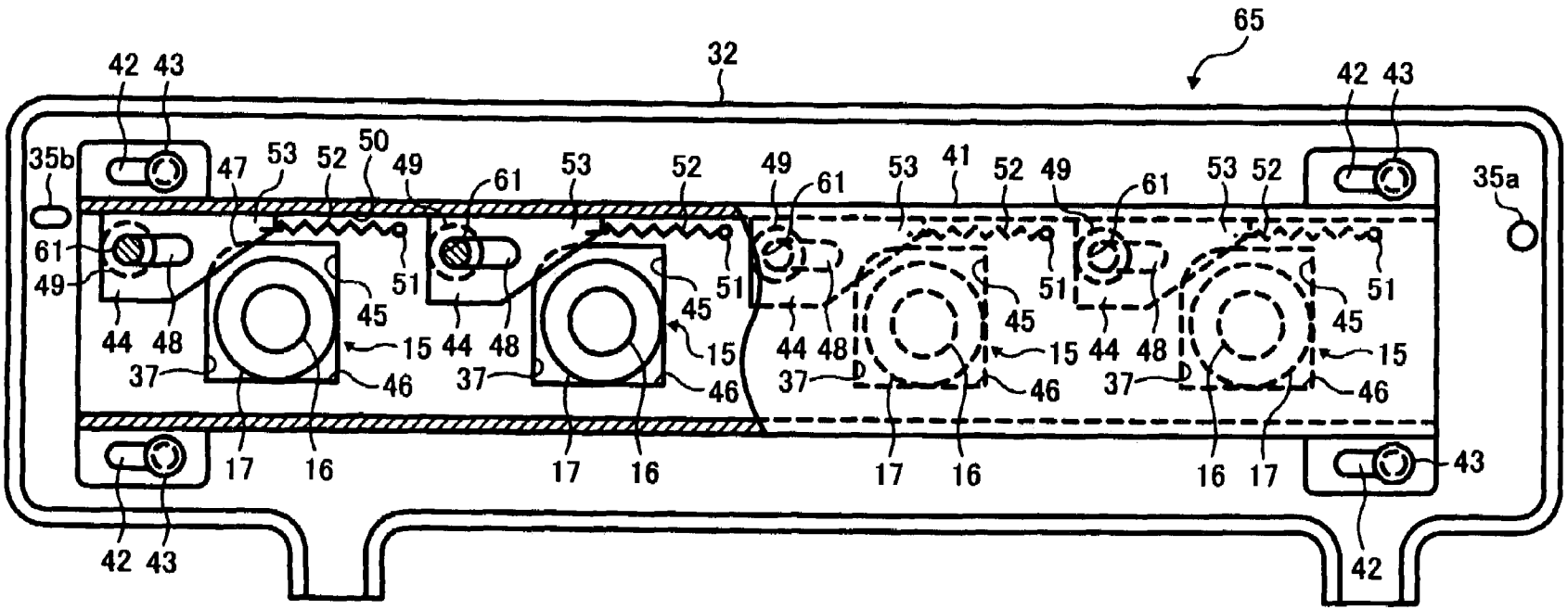
FIG. 4 is a front view illustrating a position determination holder at a closed position and a slide member at a primary position according to the comparative structure of FIG. 2.

Next, a description will be given of an example structure in which the front portion of each image carrier supporting member 15 is positioned with respect to the frame 33 of the image forming apparatus main body 7. FIG. 4 illustrates a state in which the position determination holder 32 is positioned at a predetermined mounting position, and is a figure seen in an arrow IV-direction of FIG. 2. As illustrated in FIG. 4, as described above, each of the process cartridges 1Y through 1BK is pushed into the back of the image forming apparatus main body 7; the position determination holder 32 is swingablly moved to the closed position; and the position determining holes 35*a* and 35*b* formed in the position determination holder 32 are fitted with the position determination pins 36*a* and 36*b* provided in a protruding manner in the front plate 28 so as to position the position determination holder 32 at the predetermined mounting position. As may be seen in FIGS. 4, 2 and 6, a slide member 41 is provided in the position determination holder 32. In the slide member 41, a plurality of elongated holes 42 are formed in a horizontal direction, and each shoulder screw 43 are relatively and slidably inserted into each elongated hole 42. Each shoulder screw 43 is screwed on the position determination holder 32. Accordingly, the slide member 41 is secured by the position determination holder 32 such that the slide member 41 is movable in a horizontal direction between the primary position indicated in FIG. 4 and the secondary position indicated in FIG. 5.

When swingablly moving the position determination holder 32 from the open position shown in FIG. 3 to the closed position shown in FIG. 4, each shaft bearing 17 is inserted into each mounting hole 37 formed in the position determination holder 32. As may be seen in FIG. 4, however, the size of each mounting hole 37 is set to be larger than a cross sectional area of each supporting shaft 16 and each shaft bearing 17 engaged with the supporting shaft 16 so that each shaft bearing 17 is inserted into each mounting hole 37 with a significant allowance. Therefore, each shaft bearing 17 may be easily fitted into each mounting hole 37. As illustrated in FIG. 4, each mounting hole 37 is partitioned by two faces including a vertical face 45 serving as a holder which holds the shaft bearing 17 and a horizontal face 46, and a curved face 47. The vertical face 45 and the horizontal face 46 are almost at right angles to each other.

Figure 5:
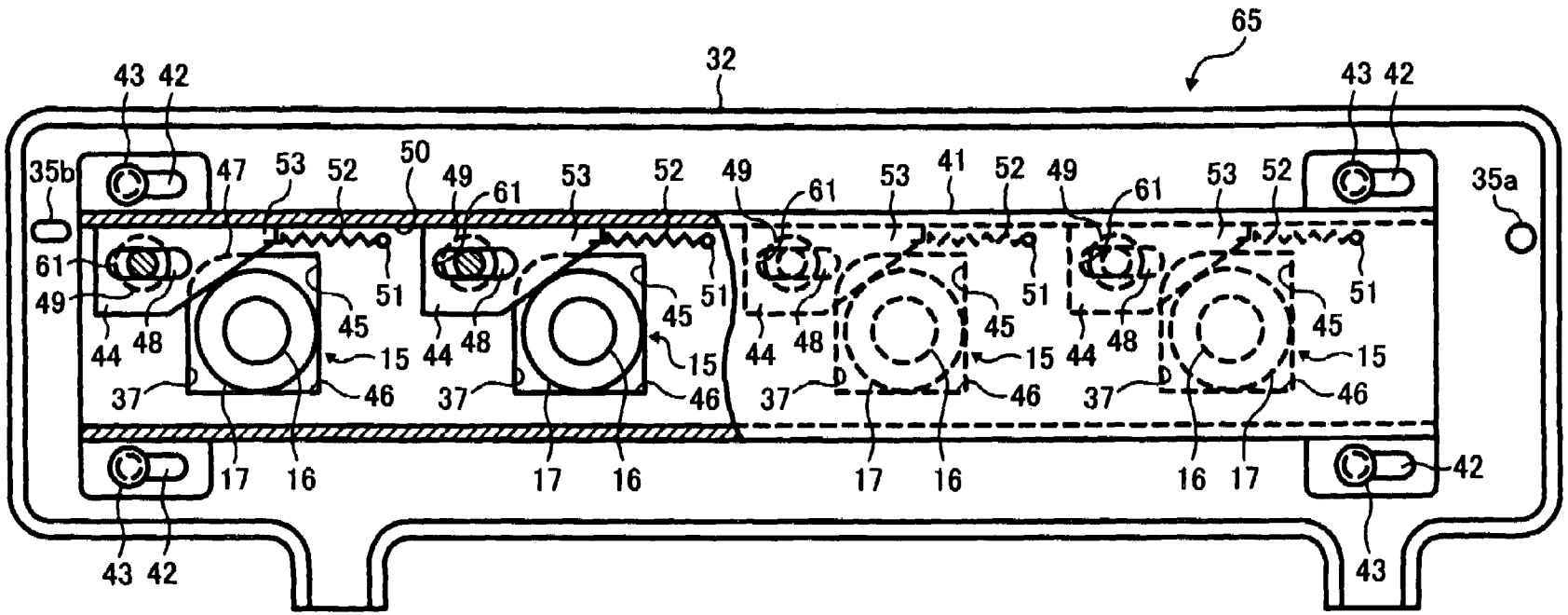
FIG. 5 is a front view illustrating the position determining unit with the position determination holder at the closed position and the slide member at a secondary position according to the comparative structure of FIG. 2.
Figure 6:
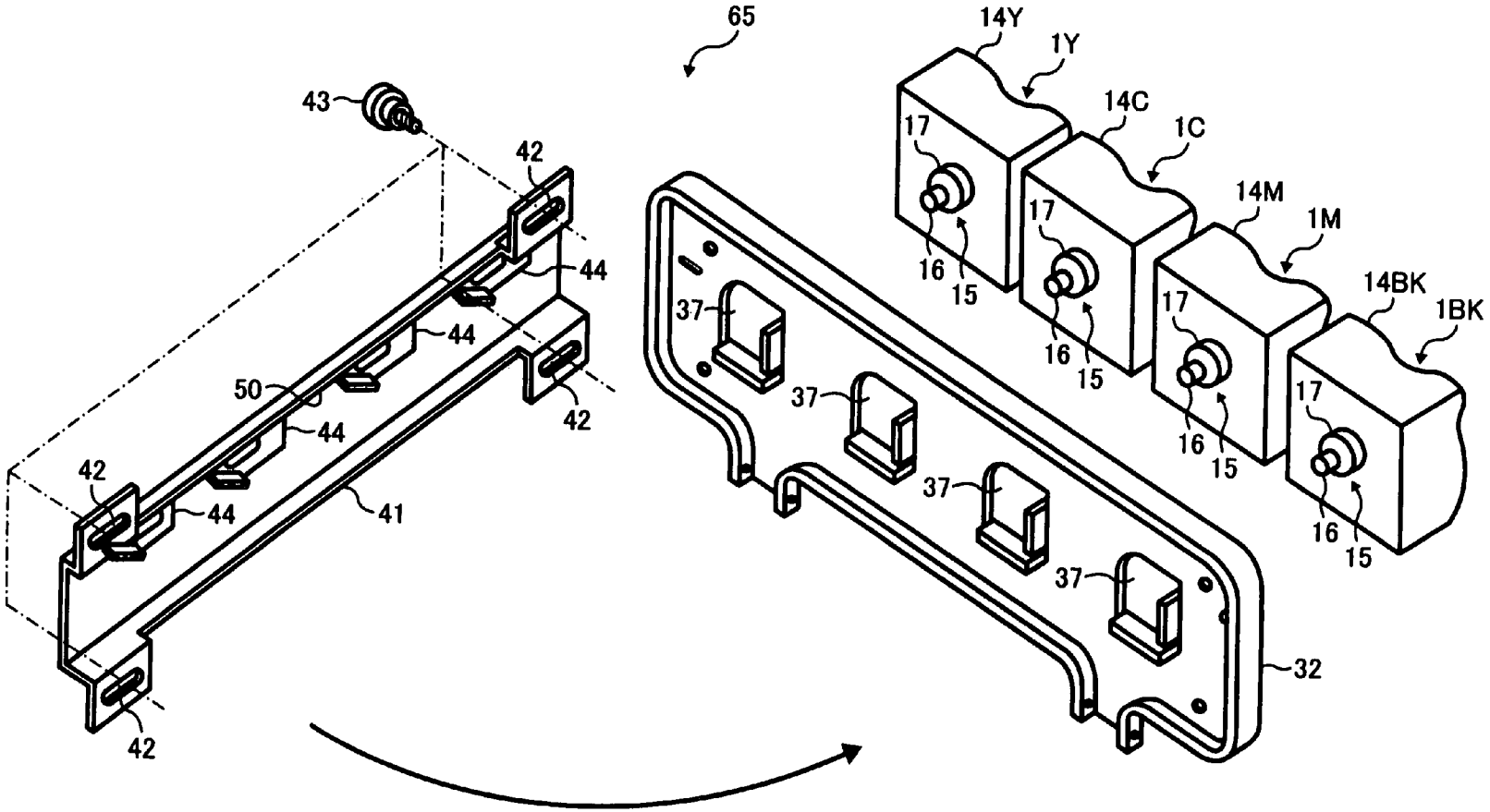
FIG. 6 is an exploded perspective view of the position determining unit and the process cartridges according to the comparative structure of FIG. 2.
Figure 7:
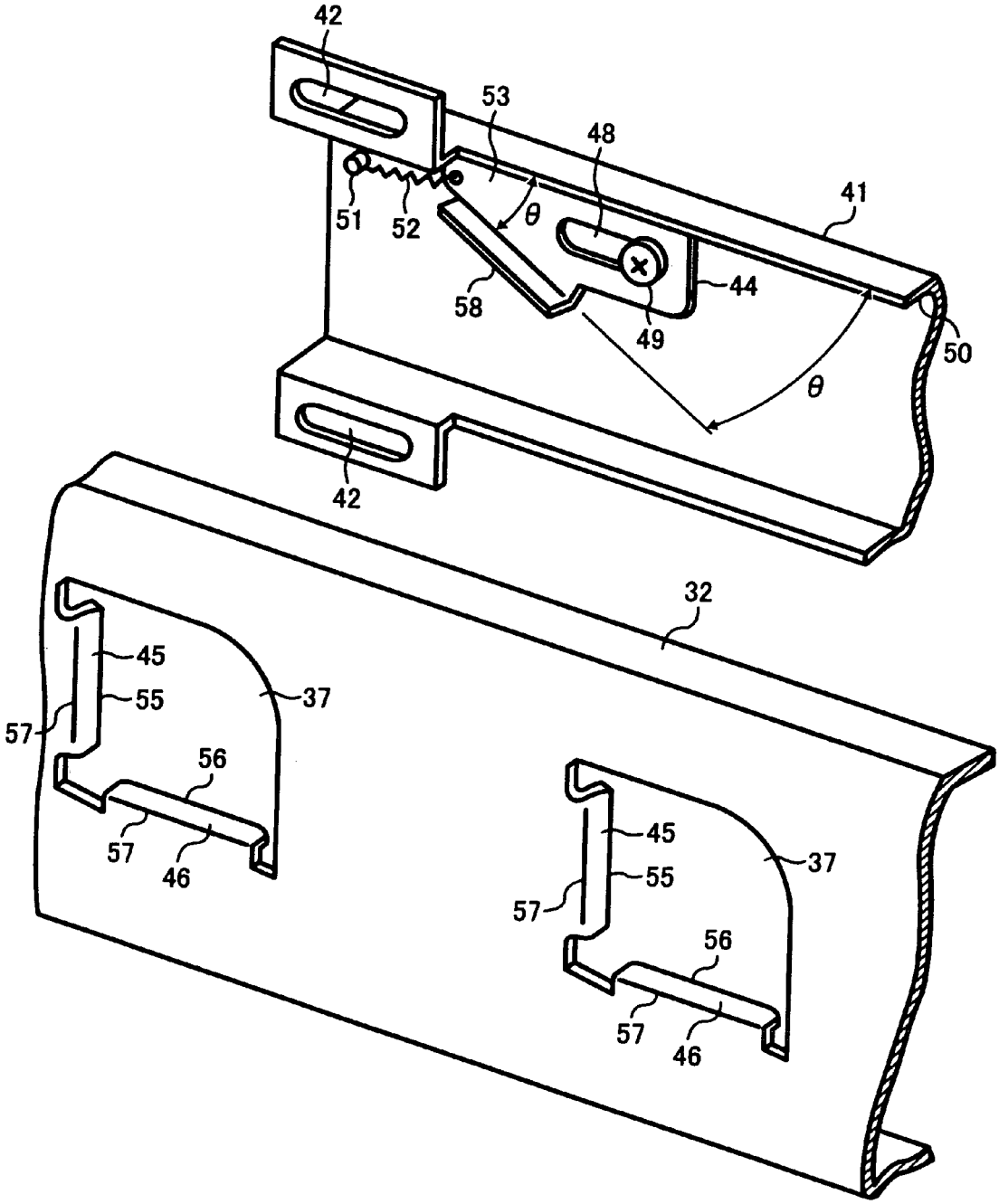
FIG. 7 is a perspective view of the position determination holder and the slide member according to the comparative structure of FIG. 2.

As illustrated in FIGS. 2 and 4 through 6, pressure members 44 are each provided corresponding to each shaft bearing 17, and each pressure member 44 includes, as shown in FIG. 7, a tapered-shaped wedge portion 53. Furthermore, in each pressure member 44, a horizontally extending elongated hole 48 is formed. In each elongated hole 48, a stopper 49 formed of a shoulder screw being screwed on a slide member 41 is relatively and slidably engaged. Consequently, each pressure member 44 may move at a predetermined stroke in a horizontal direction with respect to the slide member 41. Furthermore, the bottom surface of the upper flange of the slide member 41 serves as a guide plate 50 for guiding the pressure members 44, when each pressure member 44 moves in a horizontal direction. In such a manner, in the slide member 41, the guide plate 50 for each pressure member 44 is formed.

As illustrated in FIG. 4, on each pressure member 44 and each stake pin 51 provided in a protruding manner in the slide member 41, each end portion of a tension spring 52 serving as a spring force application mechanism is latched. Accordingly, a spring force is exerted on each pressure member 44 in the right side in FIG. 4. However, when the slide member 41 is at the primary position shown in FIG. 4, one end portion 61 of above-described each elongated hole 48 comes into contact with each stopper 49, and each pressure member 44 is stopped at the position indicated in FIG. 4. At this time, each pressure member 44 does not come into contact with the shaft bearing 17 of each image carrier supporting member 15. Each pressure member 44 is movably supported by the slide member 41 while a spring force is exerted on the pressure member 44. When the slide member 41 is at the primary position, the pressure member 44 on which the spring force has been exerted is regulated by the stopper 49 provided in the slide member 41 so as not to come into contact with the image carrier supporting member 15. Consequently, when an operator manually moves the holder 32 from the open position shown in FIG. 2 to the closed position shown in FIG. 4, each shaft bearing 17 is inserted into each mounting hole 37 without intervening each pressure member 44.

Next, when the operator manually slides the slide member 41 to the right so that the slide member 41 is at the secondary position shown in FIG. 5, the wedge portion 53 of each pressure member 44 is pressed into a space between the guide plate 50 and the shaft bearing 17 of each image carrier supporting member 15, and subsequently, each shaft bearing 17 is pressed against the faces 45 and 46 comparting each mounting hole 37. A detailed description will be given of the process thereof as follows.

When initiating the slide member 41 to move from the primary position shown in FIG. 4 to the secondary position shown in FIG. 5, the spring force is exerted on the slide member 41 by each spring 52. Each pressure member 44 regulated by each stopper 49 starts moving to the right in FIG. 4 with the slide member 41. Subsequently, when the slide member 41 reaches the predetermined position between the primary position and the secondary position, the wedge portion 53 of each pressure member 44, to which the pressure force is applied by each spring 52, is pressed in between each shaft bearing 17 pressing a periphery surface of each shaft bearing 17, and then stops. Accordingly, each pressure member 44 strenuously presses each shaft bearing 17 against the faces 45 and 46 of each mounting hole 37. When moving the slide member 41 to the secondary position against the spring force of each spring 52 after each pressure member 44 stops, each end portion 61 of the elongated hole 48 formed in each pressure member 44 is released from each stopper 49, thereby freeing each pressure member 44 from the control of each stopper 49.

As described above, due to the pressure force by the wedge portion 53 of each pressure member 44 on which the spring force is applied by each spring 52, each shaft bearing 17 is pressed against the faces 45 and 46 of each mounting hole 37. Therefore, each image carrier supporting member 15 and the front portion of the photoreceptor drums 6Y through 6BK supported by the respective image carrier supporting member 15 are appropriately positioned with respect to the position determination holder 32. At this time, since the position determination holder 32 is appropriately positioned with respect to the frame 33, the photoreceptor drums 6Y through 6BK will also be appropriately positioned with respect to the frame 33 of the image forming apparatus main body 7. When the operator installs the position determination holder 32 at the predetermined position with respect to the frame 33 and moves the slide member 41, the photoreceptor drums 6Y through 6BK may be positioned with respect to the image forming apparatus main body 7. Moreover, the size of the mounting holes 37 formed in the position determination holder 32 may be configured much larger than the cross sectional area of the front end portion of each image carrier supporting member 15 so that each image carrier supporting member 15 may be easily fitted into each mounting hole 37.

As will be understood, the dimension accuracy of the position determination holder 32 relative to the frame 33, the pitch of the faces 45 and 46 of each mounting hole 37 of the position determination holder 32 and the dimension accuracy of each part are configured to be within the predetermined accuracy range or tolerance in order to determine the position of the photoreceptor drums 6Y through 6BK relative to the image forming apparatus main body 7. As described above, the pressure mechanism is provided corresponding to each image carrier supporting member 15, and movably supports a plurality of pressure members 44 movable between a non-pressing position at which each image carrier supporting member 15 on each holder or the faces 45 and 46 does not come into contact and a pressing position at which each image carrier supporting member 15 on the holder or the faces 45 and 46 is pressed to be positioned. The pressure mechanism also movably supports each pressure member 44 and the tension springs 52 serving as the spring force application mechanism which exerts the spring force on each pressure member 44 in a direction of the pressing position. Furthermore, the pressure mechanism is configured with the single slide member 41 movably supported by the position determination holder 32 between the primary position corresponding to the non-pressing position and the secondary position corresponding to the pressing position, and a not-shown travel mechanism to move the slide member 41 between the primary position and the secondary position.

In a related art image carrier unit according to Japanese Patent Laid-Open Publication JP2001-222207, for example, since the dimension accuracy for a position determining portion of the shaft bearing portion 201 of the CRG receiver 200 for determining the position in a horizontal direction is secured, friction resistance at the time when each photoreceptor drum 12 is engaged with the shaft 12*a* is significant. Thus, even if the position in a vertical direction is determined by gradually shifting a contact timing of the auxiliary members 115 and 116 with respect to the shaft 12*a* of each photoreceptor drum 12, the same level of easy operability described in the exemplary embodiment may not be attained. Furthermore, degradation of the position determining and engaging portions may occur.

As described above, the image forming apparatus according to FIGS. 1 through 7 includes the pressure member 44 which presses the image carrier supporting member 15 loosely engaged with, that is, inserted into each mounting hole 37 against the faces 45 and 46 which partition the mounting hole 37. The pressure member 44 is pressed into the space between the guide plate 50 and the image carrier supporting member 15 and includes the wedge portion 53 which presses the image supporting member 15. Moreover, when the slide member 41 is at the primary position, the pressure member 44 on which the spring force is exerted by the spring 52 is regulated by the stopper 49 provided to the slide member 41, and is prevented from coming into contact with the image carrier supporting member 15. When the slide member 41 is moved from the primary position to the secondary position, the spring force is applied to the pressure member 44, and the pressure member 44 regulated by the stopper 49 is moved together with the slide member 41. When the slide member 41 reaches the space between the primary position and the secondary position, the wedge portion 53 of the pressure member 44, on which the spring force is exerted, is pressed into between the guide plate 50 and the image carrier supporting member 15, and stops. The position of the slide member 41, pressure member 44 and the spring 52 is set such that by moving the slide member further to the secondary position, the pressure member 44 is released from the control of the stopper 49.

When the slide member 41 is at the secondary position shown in FIG. 5, the wedge portion 53 of each pressure member 44 is pressed into the space between the guide plate 50 and the periphery surface of each shaft bearing 17 so that the position of the image carrier supporting member 15 is secured at the legitimate position by the frictional force and the spring force of the spring 52, continuously positioning each of the photoreceptor drums 6Y through 6BK. When manually returning the slide member 41 again to the primary position shown in FIG. 4, each pressure member 44 is released from the periphery surface of each shaft bearing 17 so that the position determination holder 32 is swung to the open position of FIG. 3.

The faces 45 and 46 of each mounting hole 37, against which each image carrier member 15 is pressed, are almost at right angles to each other so that each image carrier supporting member 15 may be maintained in a stable condition, and the position thereof may be accurately determined. Furthermore, as shown in FIG. 7, when the angle of the wedge portion 53 of each pressure member 44 is θ, and the angle θ is too large, a significant amount of force will be necessary in order to press the wedge portion 53 into the space between the guide plate 50 and the shaft bearing 17, deteriorating the operability. On the other hand, when the angle θ is too small, the operational stroke of the pressure member 44 will become larger, also deteriorating the operability. In light of the above, it is preferred to set the angle θ to be between 5 degree and 45 degree, particularly between 15 degree and 20 degree.

Furthermore, as shown in FIGS. 2 and 7, if the faces 45 and 46 of the mounting holes 37 formed in the position determination holder 32 are formed of tongue sections 55 and 56 which have been cut and bent through pressure molding, a round portion 57 is formed in the base portion of the tongue sections 55 and 56. Therefore, when the position determination holder 32 is rotatively moved to the closed position shown in FIG. 2, the round portion 57 slidingly contacts the shaft bearing 17 so that it is possible to reduce the likelihood or prevent the shaft bearing 17 from getting damaged.

Similarly, when the surface of the pressure member 44, which comes into contact with the image carrier supporting member 15, is formed of a tongue section 58 which has been cut and bent through pressure molding, as shown in FIG. 2, a round portion 60 is formed in the base portion of the tongue section 58. Therefore, when the pressure member 44 comes into contact with the shaft bearing 17 of the image carrier supporting member 15, it is possible to reduce the likelihood or prevent the shaft bearing 17 from getting damaged.

The above-described image forming apparatus includes a plurality of photoconductive drums 6Y through 6BK. A plurality of pressure members 44 which press the image carrier supporting members 15 for supporting each respective photoreceptor drums are each movably supported by the common slide member 41. Accordingly, by moving only the single slide member 41, all of the pressure members 44 are operated so as to be able to press each image carrier supporting member 15 against the faces 45 and 46 of each mounting hole 37.

The not-shown image forming apparatus is configured such that the photoreceptor drums 6Y through 6BK are fixed to and supported by the supporting shaft 16 of each image carrier supporting member 15 so that each photoconductive drum is rotated by rotatively driving the supporting shaft 16 of each image carrier supporting roller 15. Accordingly, the shaft bearing 17 is attached to the front portion of the supporting shaft 16 of each image carrier supporting member 15, and each shaft bearing 17 is loosely fitted in each mounting hole 37. On the other hand, in a case where the image forming apparatus is configured such that each photoconductive drum is rotatably supported by each supporting shaft, and each photoconductive drum is rotatively driven without rotating the supporting shaft thereof, the supporting shaft may be immediately fitted in the mounting hole. Consequently, in this case, it is possible not to provide the shaft bearing 17, which is loosely fitted in the mounting hole 37, to the image carrier supporting member.

In the image forming apparatus of the exemplary embodiment, the supporting shaft 16 is integrally mounted in each of the photoconductive drums 6Y through 6BK, however, each supporting shaft may be either rotatably or not-rotatably mounted on the frame of the image forming apparatus main body, and the photoreceptor drums may be detachably mounted in the shaft line direction with respect to the supporting shaft. The above-described configuration may be applied to such an image forming apparatus. In this case, when the supporting shaft is rotatably supported by the frame of the image forming apparatus main body, the image carrier supporting member is configured with the supporting shaft and the shaft bearing attached to the front portion of the supporting shaft. On the other hand, when the supporting shaft is not rotatably mounted in the frame, the supporting shaft may be immediately fitted in the mounting hole of the position determination holder.

Each configuration shown in FIGS. 1 through 7 may be applied, without any difficulty, to an image forming apparatus with only one photoconductive drum. Since the position determination holder 32, the slide member 41 and each of the pressure members 44 are integrally formed by a metal sheet, it is cost effective, and a predetermined strength, abrasion resistance and durability may be attained.

Figure 8:
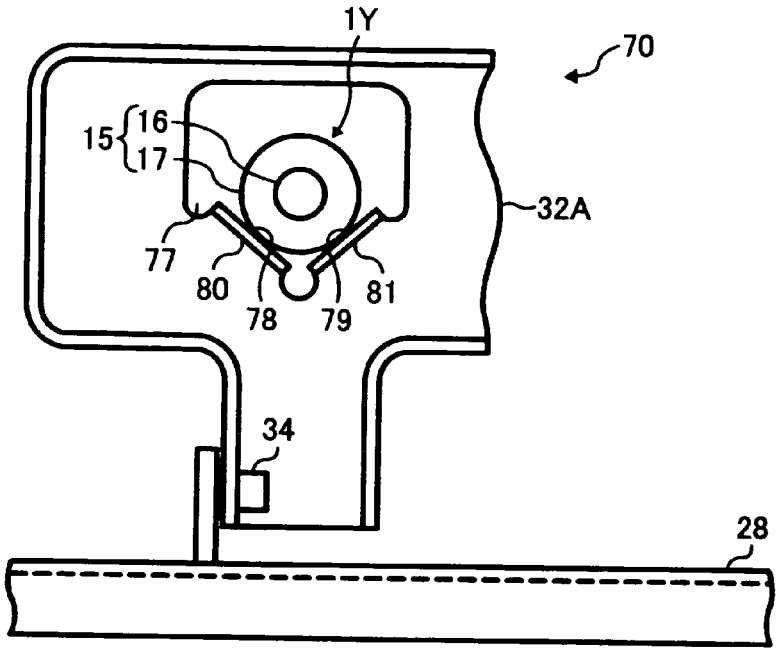
FIG. 8 is a front view illustrating a position determination holder with a mounting hole of a position determining unit of a color image forming apparatus according to an exemplary embodiment of the present invention.
Figure 9:
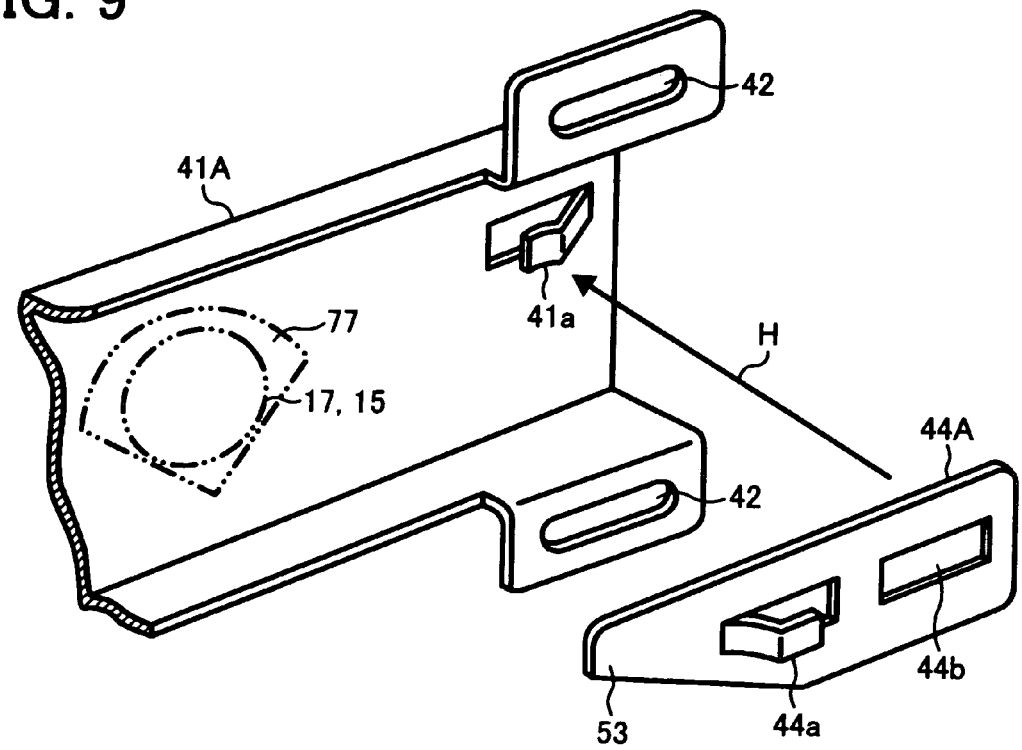
FIG. 9 is an exploded perspective view illustrating a slide member and a pressure member according to an exemplary embodiment of the present invention.
Figure 10:
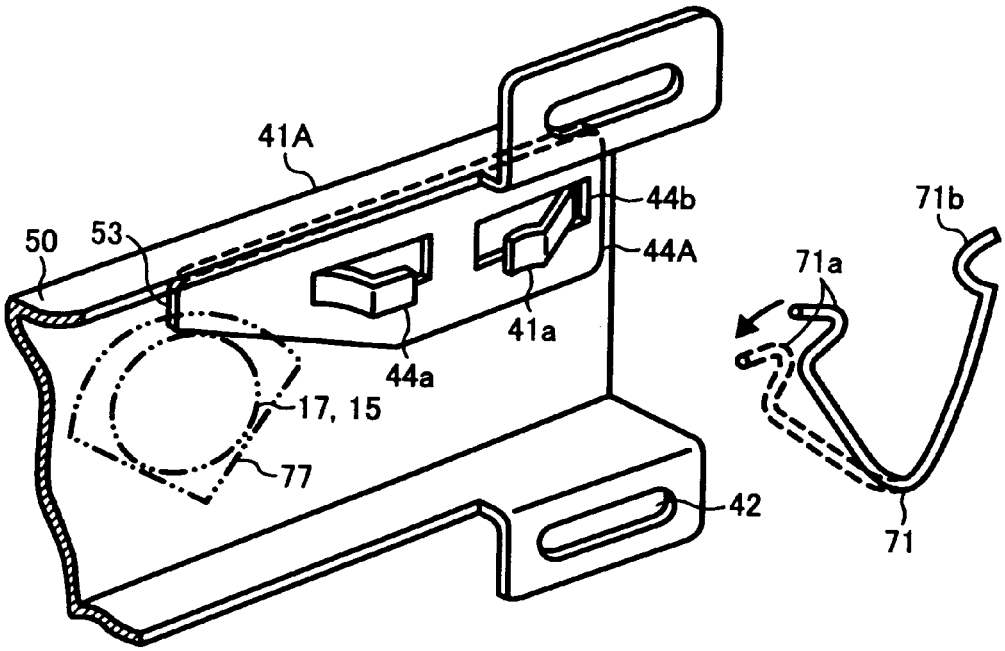
FIG. 10 is an exploded perspective view illustrating the slide member, the pressure member, and a spring according to an exemplary embodiment of the present invention.
Figure 11:
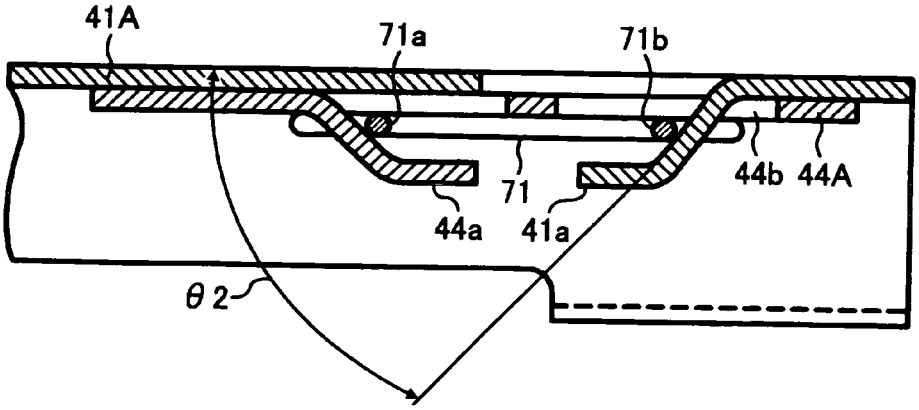
FIG. 11 is a cross sectional view for explaining relationships between a bent angle of a cut-bent shape portion of the slide member and the spring of FIG. 10.
Figure 13:
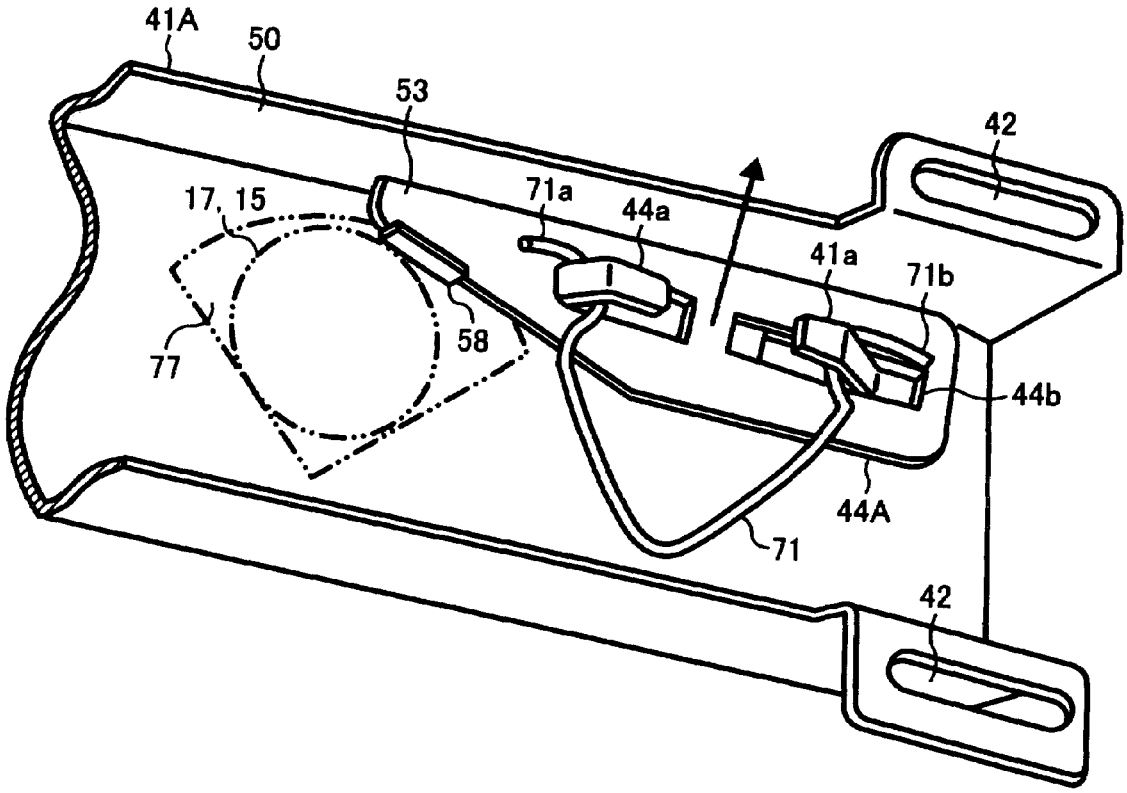
FIG. 13 is a perspective view illustrating the slide member, the pressure member and the spring.
Figure 14:
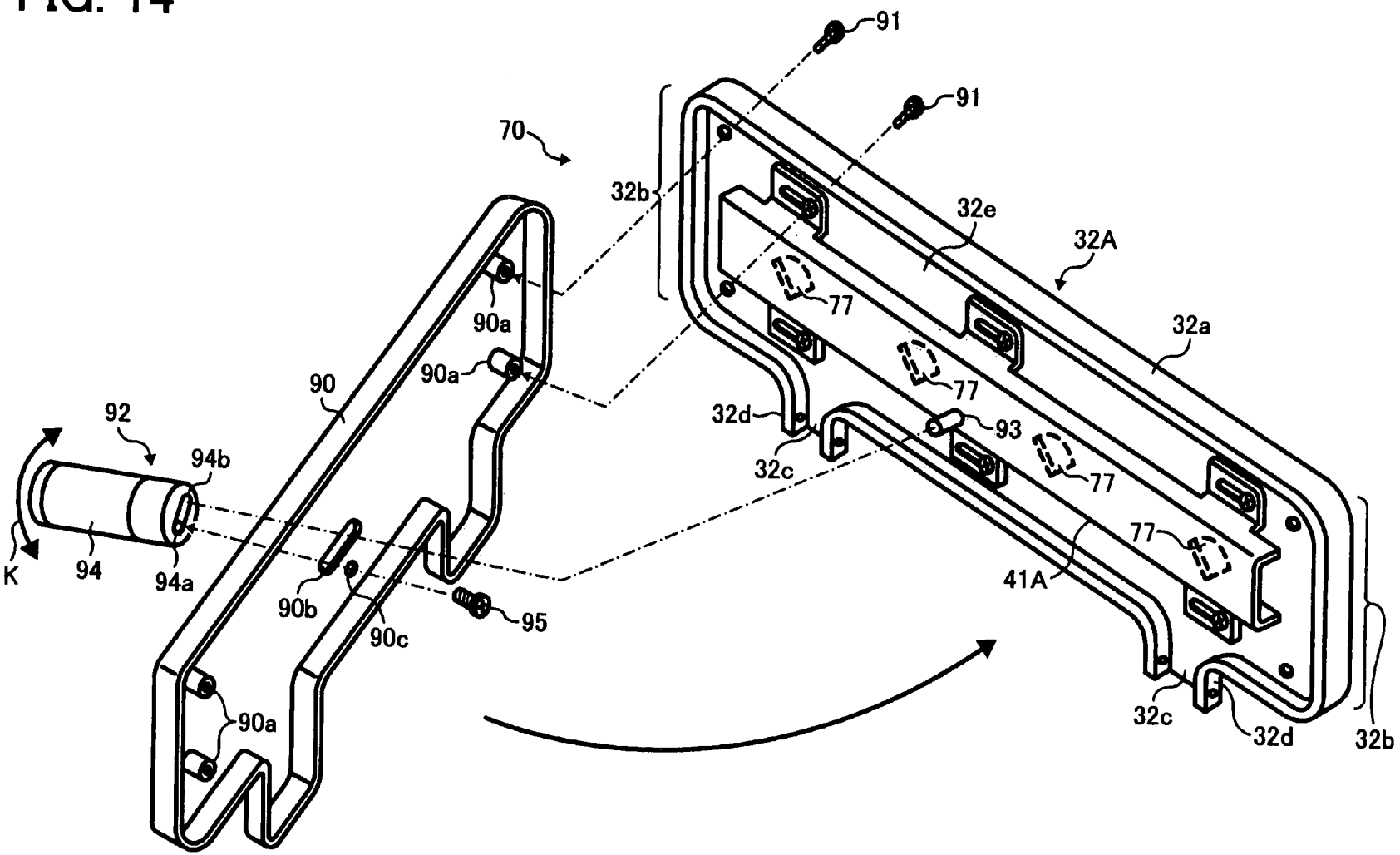
FIG. 14 is an exploded perspective view illustrating installation of a lever to the position determining unit of FIG. 8.
Figure 15:
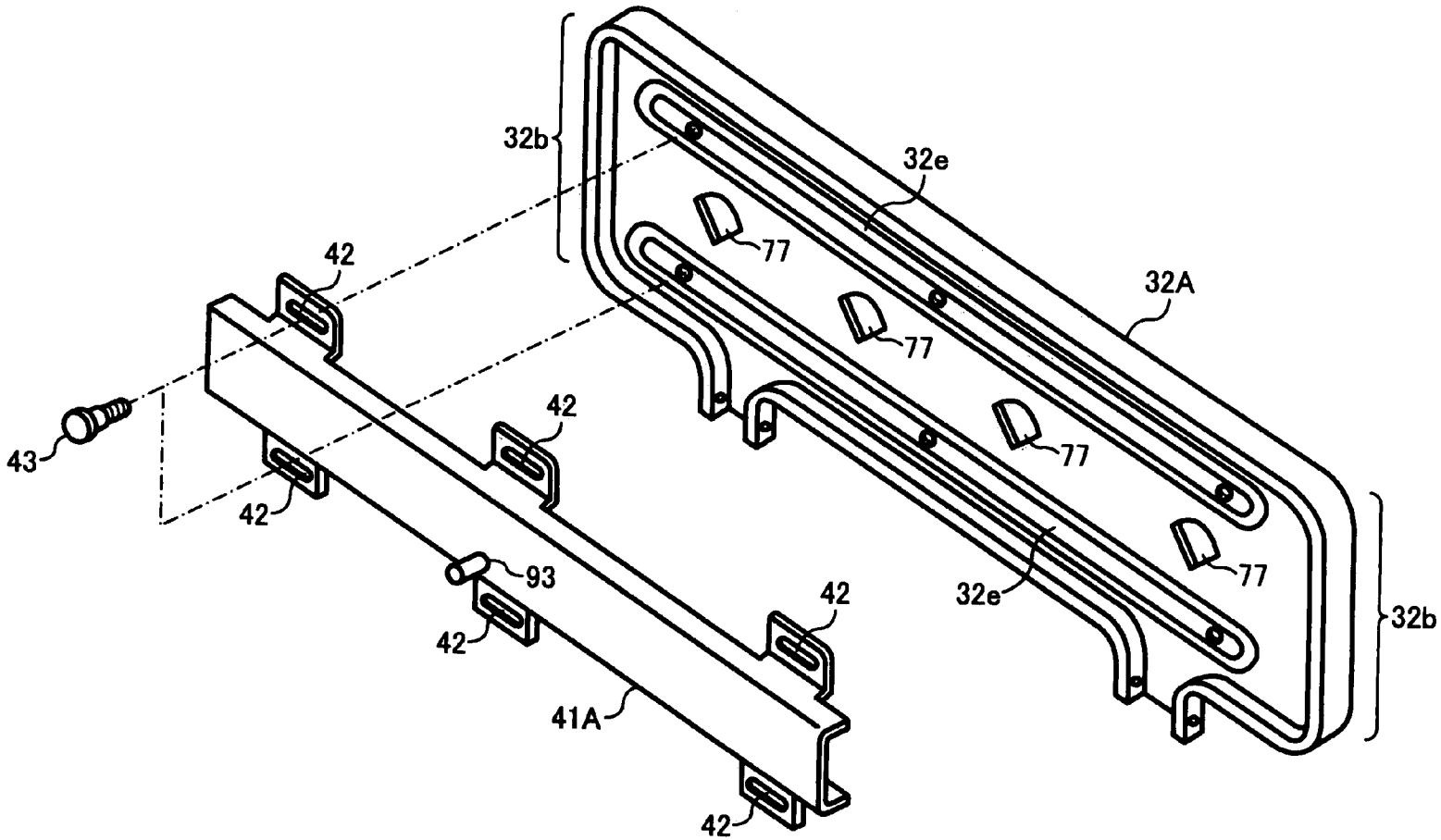
FIG. 15 is an exploded perspective view for explaining installation of the slide member to the position determination holder.

A first exemplary embodiment is illustrated in FIGS. 8 through 16. When compared with the image forming apparatus of the comparative example shown in FIGS. 1 through 7, the image forming apparatus of the first exemplary embodiment utilizes the position determining unit 70 shown in FIG. 8 and so forth, instead of the position determining unit 65. When compared with the position determining unit 65, in the position determining unit 70, a position determination holder 32A serving as a holding member shown in FIG. 8 and so forth is used, instead of the position determination holder 32 A slide member 41A constituting a pressure mechanism shown in FIG. 15 is used, instead of the slide member 41. Pressure members 44A constituting a pressure mechanism shown in FIGS. 9 through 11 are used, instead of the pressure members 44 The stopper 49 formed of the shoulder screw is eliminated A cover member 90 is provided facing the position determination holder 32A with the slide member 41A provided therebetween. A travel mechanism 92 is provided to move the slide member 41A between a primary position and a secondary position. Unless otherwise indicated above, the position determining unit 70 is similar to the position determining unit 65.

As illustrated in FIGS. 8 and 14, the position determining unit 70 is mainly configured with the single position determination holder 32A having two faces 78 and 79 serving as a holding portion formed in opening mounting holes 77 in which each image carrier supporting member 15 is held, when the position determining unit 70 is closed relative to the opening 31 of the front plate 28 of FIG. 2, and a later-described pressure mechanism configured to carrying out positioning by pressing each image carrier supporting member 15 held by the faces 78 and 79. Similarly to the comparative example, the position determination holder 32A, the slide member 41A and each of the pressure members 44A are integrally formed by a metal sheet. Therefore, it is cost effective, and a specified strength, abrasion resistance and durability may be attained.

In the position determination holder 32A, when compared with the position determination holder 32, the mounting holes 77 are formed instead of mounting holes 37, and the strength of the position determination holder 32A is enhanced while the description of the strength of the position determination holder 32 is omitted. As shown in FIG. 8, in the mounting holes 77, tongue sections 80 and 81 including the faces 78 and 79 serving as a holding portion on which each image carrier supporting member 15 is held by the weight of each of process cartridges 1Y through 1BK are uniformly formed. The tongue sections 80 and 81 including the faces 78 and 79 are formed such that the tongue sections 80 and 81 are at right angles to each other, each having an equal angle (approximately 45 degree angle) to a vertical line in the center. Consequently, a similar effect as the faces of a V-block used for centering a round-bar shaped shaft is attained.

On the other hand, when each image carrier supporting member 15 is positioned and held in the mounting holes 37 including the vertical surface 45 and the horizontal surface 46 shown in FIGS. 6 and 7, there may be a possibility that the mounting and/or holding condition of the image carrier supporting member 15 on the faces 45 and 46 by the weight of each of the process cartridges 1Y through 1BK may not be stable. In this case, even if pressure force is exerted by the pressure members 44, each image carrier supporting member 15 may be caught on the horizontal surface 46 without coming into contact with the vertical surface 45 so that the image carrier supporting members may not be held at a predetermined position. The exemplary embodiment has been proposed to address this problem. Similarly to the comparative example shown in FIG. 7, if the faces 78 and 79 are formed of the tongue sections 80 and 81 which have been cut and bent through pressure molding, a round portion is formed in the base portion of the tongue sections 80 and 81. Therefore, when the position determination holder 32A is rotatively moved to the closed position shown in FIG. 2, the round portion slidingly contacts the shaft bearing 17 so that it is possible to reduce the likelihood or prevent the shaft bearing 17 from getting damaged.

The image carrier supporting members 15 may be held by cut surfaces which correspond to the plate thickness of the mounting holes 77 without forming the tongue sections 80 and 81. For the sake of simplicity, the tongue sections 80 and 81 are illustrated merely in FIG. 8, and the illustration of the tongue sections 80 and 81 is omitted in other FIGs. The mounting holes 77 have a predetermined shape to sustain a weight of the image carrier unit through the supporting member in a vertical direction and to grip the supporting member in a horizontal direction. The shape of the mounting holes 77 is accurately illustrated in FIG. 8. However, in other FIGs, the shape thereof is simplified and depicted in an almost fan-shape or V-shape. It is understood that the dimension accuracy of the position determination holder 32A relative to the frame 33, and the pitch of the faces 78 and 79 of each mounting hole 37 of the position determination holder 32A and the dimension accuracy of each part are configured within the predetermined accuracy range (tolerance) in order to position the photoreceptor drums 6Y through 6BK relative to the image forming apparatus main body 7.

As shown in FIG. 14, the cover member 90 is integrally formed of, for example, resin. On the left and right end portions thereof, screw bosses 90*a* for fixing screws 91 are formed in a protruding manner. On the other hand, on the both end portions of the position determination holder 32A, holes for insertion of the screws 91 are formed so that the cover member 90 and the position determination holder 32A are fixed by the screws 91. The fixing positions of the cover member 90 and the position determination member 32A by the screws 91 are provided outside the four mounting holes 77 with a holding portion. Accordingly, strength of the position determination holder 32A is secured, and it is especially effective in terms of enhancement of the strength against distortion.

As shown in FIG. 14, on the position determination holder 32A, a drawn shape 32*a* is molded along at least one long side and at both ends of short sides thereof, thereby forming a flange all around the position determination holder 32A. Accordingly, the strength of the position determination holder 32A is adequately secured. Furthermore, areas from image carrier supporting member holding portions 32*b* of the position determination holder 32A to portions 32*c* which engage with swing points which are a pair of hinge pins 34 of the position determination holder 32A shown in FIG. 8 are integrally formed. The flange molded into a drawn shape 32*d* connects the above-described portions 32*c* to the image carrier supporting member holding portions 32*b*, thereby securing strength of the area from the swing points of the position determination holder 32A to the image carrier supporting member holding portions 32*b* even more.

As shown in FIG. 15, on the position determination holder 32A, drawn shapes 32*e* are molded along long sides of the image carrier supporting member holding portions 32*b*, thereby further securing the strength of the position determination holder 32A. In addition, drawn shapes 32*e* are formed extending further outside than the holding portion toward the both left and right end portions of the left and right mounting holes 77 of the image carrier supporting member holding portions 32*b*, thereby securing the strength of the position determination holder 32A even more.

Figure 17A:
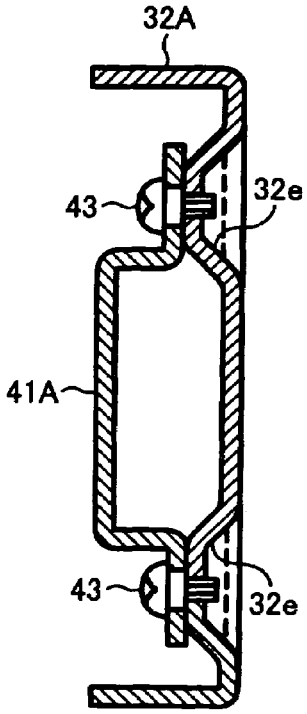
FIGS. 17A and 17B are cross sectional views for explaining effects of projections of the position determination holder supporting the slide member.
Figure 17B:
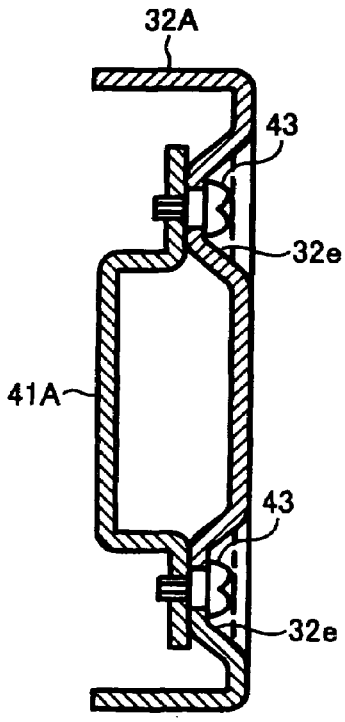

As shown in FIGS. 17A and B, on the drawn shape portions 32*e* of the position determination holder 32A, sliding-engagement portions which slidingly engage with a slide member 41A are provided. Accordingly, the screw head or the tip of the shoulder screws 43 do not stick out of the surface of the position determination holder 32A, thereby reducing the likelihood or preventing hands of a user from getting caught by the screw head or the tip of the shoulder screws 43. Furthermore, according to an example shown in FIG. 15, the sliding-engagement portions which slidingly engage the position determination holder 32A with the slide member 41A are provided on the end portions and in the center of the slide member 41A so that the position determination holder 32A and the slide member 41A are engaged with one another at a plurality of positions, more positions than when engaging at the end portions of the slide member 41A, thereby adequately securing the strength of the position determination holder 32A. As described above, when compared with the slide member 41 shown in FIG. 6 and so forth, in the slide member 41A, a pin 93 configuring a travel mechanism 92 is planted, and the sliding-engagement portions for sliding are added in the center according to the example shown in FIG. 15.

The pressure mechanism in an exemplary embodiment of the present invention, as shown in FIGS. 8 through 13, is provided corresponding to each image carrier supporting member 15, and movably supports a plurality of pressure members 44A movable between a non-pressing position at which each image carrier supporting member 15 on the faces 78 and 79 does not come into contact and a pressing position at which each image carrier supporting member 15 thereon is pressed to determine the position. The pressure mechanism also movably supports the U-shape springs 71 serving as the spring force application mechanism which exerts the spring force on each pressure member 44A in a direction of the pressing position. Furthermore, the pressure mechanism is configured with the single slide member 41A movably supported by the position determination holder 32A between the primary position corresponding to the contactless non-pressing position and the secondary position corresponding to the pressing position.

The slide member 41A includes the guide plate 50 serving as a guide part for guiding each pressure member 44A to a space between the non-pressing position and the pressing position, a plurality of tab portions 41*a* serving as a stopper part which controls and holds each pressure member 44A at the non-pressing position when the slide member 41A is at the primary position. The tab portions 41*a* further include a function of a primary locking part formed adjacent to each mounting hole 77. Each pressure member 44A has the wedge portion 53 pressed into a space between the guide plate 50 and each image carrier supporting member 15 on the faces 78 and 79 so as to press each image carrier supporting member 15. As shown in FIG. 13, similarly to the pressure members 44 shown in FIG. 7 as a comparative example, when the surface of the pressure member 44A, which comes into contact with the shaft bearing 17 of the image carrier supporting member 15, is formed of the tongue section 58 which has been cut and bent through pressure molding, a round portion is formed in the base portion of the tongue section 58. Therefore, when the pressure member 44A comes into contact with the shaft bearing 17 of the image carrier supporting member 15, it is possible to reduce the likelihood or prevent the shaft bearing 17 from getting damaged. In FIGS. 9, 10, 13 and so forth, the fan-shape and the circle shown by the dash-double dotted line indicate a state reflecting the virtual existence of the mounting hole 77 and the shaft bearing 17 of the image carrier supporting member 15.

The pressure members 44A having the taper-shaped wedge portion 53 similar to the above-described comparative example are disposed at a position corresponding to each of the tab portions 41*a* of the slide member 41A. On each pressure member 44A, an elongated hole 44*b* formed within a moving area between the non-pressing and pressing positions, and a tab portion 44*a* facing an opposite direction of the tab portion 41*a* are formed. The slide member 41A and the pressure member 44A are engaged as indicated by an arrow H in FIG. 9. The above-described slide member 41A and the pressure member 44A are configured such that the tab portions 41*a* and 44*a* face each other as shown in FIG. 10.

In a space between the tab portions 41*a* and 44*b*, both bent-shape portions 71*a* and 71*b* of the spring 71 which is the U-shaped spring pressure application mechanism and an elastic member are hooked. By the elastic force of the spring 71, the pressure member 44A is held with respect to the slide member 41A, and tension is applied to a space between the pressure member 44A and the slide member 41A. A bent angle θ2 of the tab portion 41*a*, which is the stopping angle to stop the spring 71, is set to be no less than 45 degrees. If the bent angle θ2 is less than 45 degrees, the bent-shape end portion 71*b* of the spring 71 may be stuck between the tab portion 41*a* of the slide member 41A and the pressure member 44A, causing the movement of the pressure member 44A to slow down. Therefore, it is not preferable to set the bent angle θ2 to be less than 45 degrees.

Figure 12:
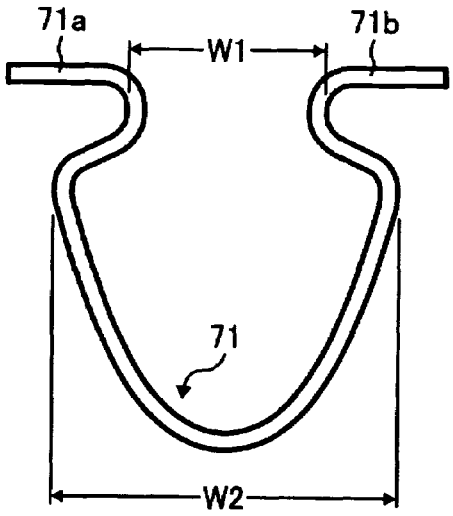
FIG. 12 is a schematic diagram of a shape of the spring of FIG. 10.

With reference to FIG. 12, a detail description will be given of the shape of the spring 71. The spring 71 has an approximate U-shape, and on both end portions thereof the bent-shape portions 71*a* and 71*b* are provided such that the bent-shape portions 71*a* and 71*b* are hooked on the tab portions 41*a* and 44*b*. A width W1, which is a width between inner curves of the bent-shape portions 71*a* and 71*b* and is also the width of an opening of the U-shape spring 71, is less than the maximum width W2 of the U-shape portion and has a hook-shape so as to be able to hook. When the width W1 is less than the width W2 (W1<W2), the tension of the spring 71 may reduce the likelihood or prevent the spring 71 from moving upward indicated by an arrow in FIG. 13. In the exemplary embodiment of the present invention, four springs are used. Thus, the load and the spring constant of the spring 71 are set such that resonance and the like may be reduced or prevented, and the relationship between the total load of four springs and operability is taken into consideration.

According to an exemplary embodiment of the present invention, the bent-shape portions 71*a* and 71*b* of the approximate U-shape spring 71 are hooked between tab portion 41*a* of the slide member 41A and the tab portion 44*a* of each pressure member 44A. Accordingly, each pressure member 44A may be held relative to the slide member 41A, and the stopper 49 which is the shoulder screw of the comparative example shown in FIG. 7 may be eliminated. In addition, since the springs 71 which are more moderate in price than the tension springs 52 of the comparative example shown in FIG. 7 are used, cost reduction may be attained. Furthermore, according to an exemplary embodiment of the present invention, the bent angle θ2 is set to be no less than 45 degrees. Consequently, the bent-shape portion 71*b* of the spring 71 may not be stuck between the tab portion 41*a* of the slide member 41A and the pressure member 44A, thereby smoothly moving the pressure member 44A. According to the exemplary embodiment of the present invention, when the width W1 is less than the width W2 (W1<W2), the tension of the spring 71 may reduce the likelihood or prevent the spring 71 from moving upward indicated by an arrow in FIG. 13.

Figure 16:
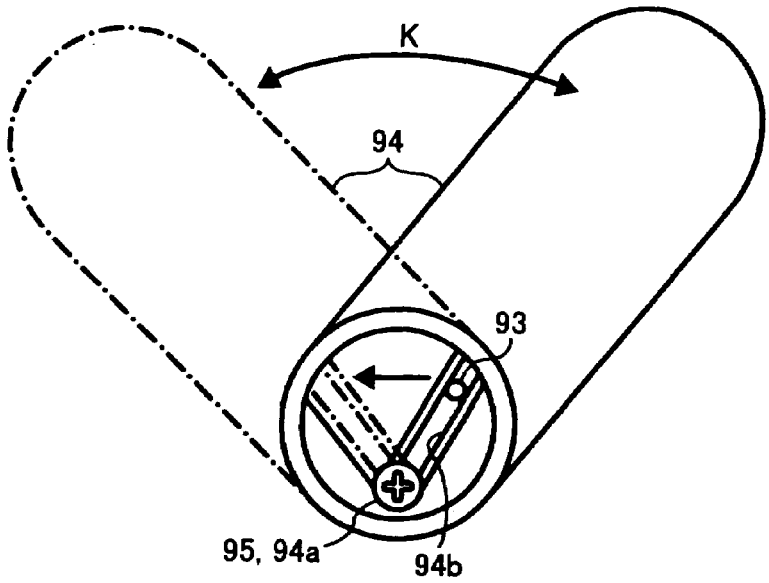
FIG. 16 is a diagram illustrating an operation of the lever.

As shown in FIGS. 14 and 16, the travel mechanism 92 is effective in moving the slide member 41A between the primary and secondary positions, and includes a lever 94 serving as an operating member swingablly provided in a K-direction on the cover member 90 shown in both FIGS. 14 and 16, and a swing motion conversion mechanism which converts the swing motion in the arrow-K direction by the lever 94 to the horizontal linear motion which is the movement of the slide member 41A. The swing motion conversion mechanism mainly includes the pin 93 planted in the slide member 41A, an elongated hole 90*b* which is horizontally formed in the cover member 90 and into which the pin 93 is inserted, a lever base end portion 94*a* fastened by the screw 95 which is inserted through a hole 90*c* formed in the cover member 90, a guide groove 94*b* formed in the base of the lever 94 into which the pin 93 is inserted. The pin 93 moves along the guide groove 94*b* and is controlled such that the pin 93 moves in the hole 90*b* in an approximate horizontal direction with the screw 95 of the lever base end portion 94*b* in the center. Accordingly, the swing motion in the arrow K direction by the lever 94 is converted into the approximate horizontal linear motion of the slide member 41A.

With reference to FIGS. 18 through 22, a description is given of a structure associated with enhancement of the position determination accuracy of the position determining unit 70 with respect to the image forming apparatus. In an exemplary embodiment of the present invention, the position determination by engaging the position determining pins 36*a* and 36*b* with the position determining holes 35*a* and 35*b* of the comparative example shown in FIG. 3 is enhanced.

Figure 18:
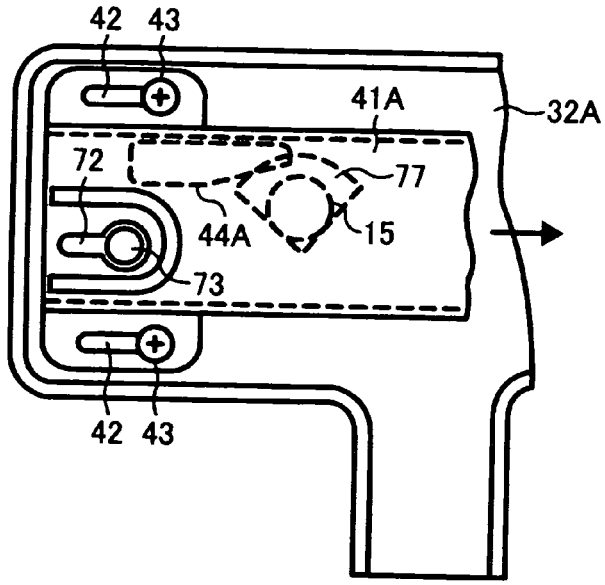
FIG. 18 is a front view illustrating relationships between positional determination of the position determination holder and the slide member.

As show in FIG. 18, on the position determination holder 32A, the slide member 41A which slides in the approximate horizontal direction shown by a bold arrow is provided. In the slide member 41A, a hole 72 having a shape of a round hole connected to an elongated hole is formed. In the position determination holder 32A, a hole 73 is formed at a position corresponding to the round hole of the hole 72, when the slide member 41A is at the primary position.

Figure 19:
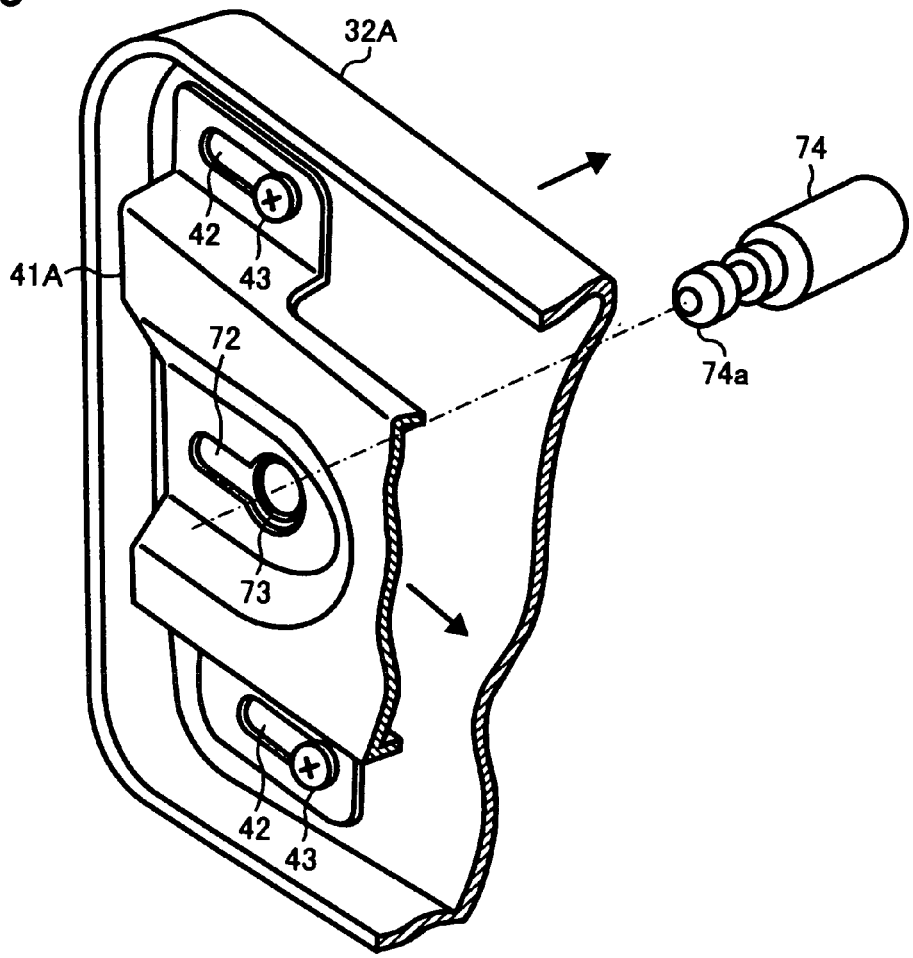
FIG. 19 is an exploded perspective view illustrating a positional determination of the position determination holder and the slide member by a position determining shaft.
Figure 20:
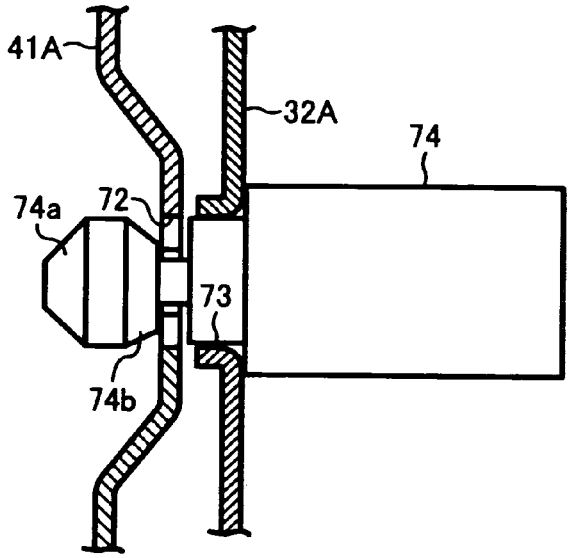
FIG. 20 is an enlarged cross sectional view illustrating a manner to fit the position determining shaft into each hole of the position determination holder and the slide member.

As shown in FIG. 19, on the image forming apparatus main body side, position determining shafts 74 are provided at a position corresponding to the holes 72 and 73, respectively. The shafts 74 advance into the holes 72 and 73 by swinging or opening/closing the position determination holder 32A toward the image forming apparatus main body. At this time, the slide member 41 is at the primary position. By sliding the slide member 41 in the horizontal direction shown by the bold arrow so as to move to the secondary position, the position determining shafts 74 engage with the holes 73 and 72, and the position determination holder 32A is fixed onto the image forming apparatus main body. Accordingly, the position determination holder 32A may be fixed to the image forming apparatus main body.

On the tip of the position determining shafts 74, as shown in FIG. 19, a chamfered portion 74*a* having a slant surface or a tapered surface is formed, thereby facilitating the position determining shafts 74 to advance into the position determination holder 32A and the holes 72 and 73 of the slide member 41A. Furthermore, as shown in the cross-sectional view in FIG. 20, on the front narrow area of the position determining shafts 74, that is, an area where the hole 72 of the slide member 41 engages, a chamfered portion 74*b* is formed so that the slide member 41A easily slides and engages.

Figure 21:
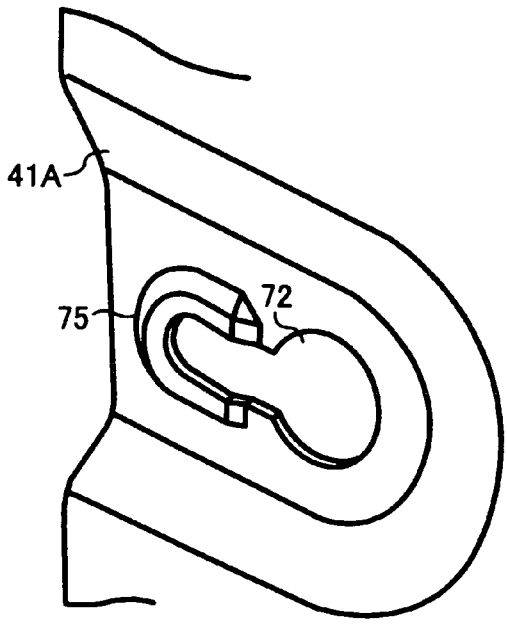
FIG. 21 is an enlarged perspective view of an elongated hole of the slide member.
Figure 22:
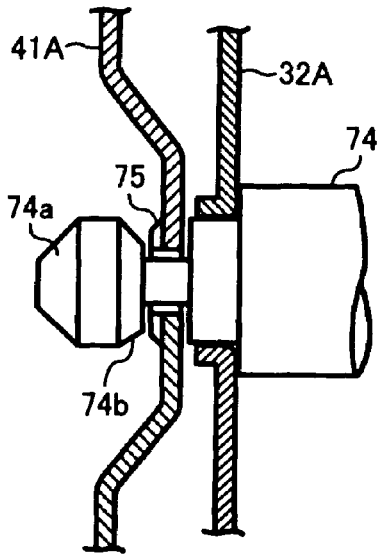
FIG. 22 is an enlarged cross sectional view illustrating a manner to fit the position determining shaft into the holes of the slide member and the position determination holder.

FIG. 21 illustrates a structure for causing the slide member 41A to move smoothly. A drawn shape 75 is formed as a convex part around the elongated hole portion of the hole 72 of the slide member 41A, thereby causing the slide member 41A to move more smoothly.

Figure 23:
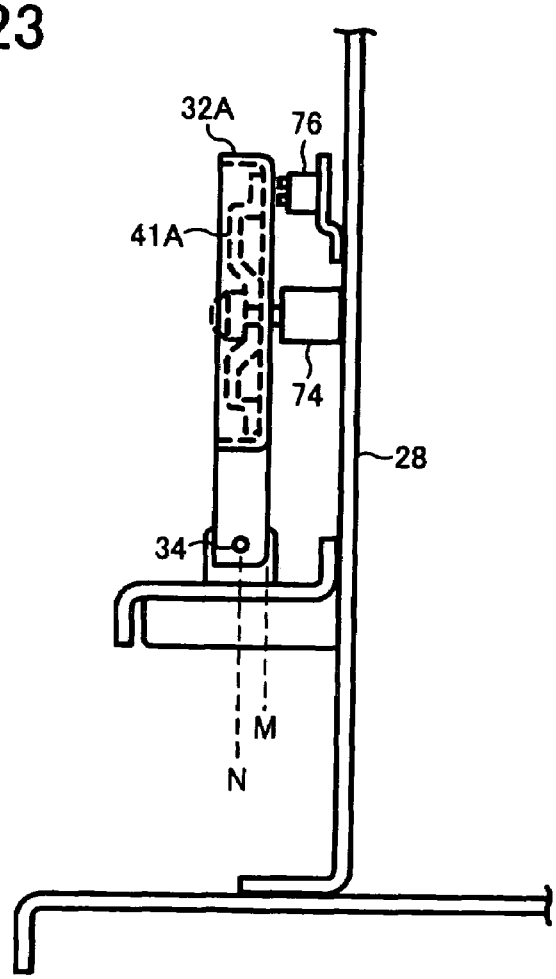
FIG. 23 is a side view illustrating a positional relationship between the position determination holder and the frame of the color image forming apparatus of FIG. 1.

FIG. 23 illustrates a positional relationship between the position determination holder 32A and the image forming apparatus main body. The position determination holder 32A is swingable and openable/closable at the hinge pin 34 serving as a support point. The support point is provided at a position outside of the surface which comes into contact with the position determining shafts 74 of the position determination holder 32A. In other words, in FIG. 23, it is understood that an M is positioned outside of an N shown by arrows, thereby reducing the likelihood or preventing the position determination member 32A from falling over to the left front side in FIG. 23.

When the position determination holder 32A is mounted to the position determining shaft 74 and is closed, the position determination holder 32A may be temporality fixed to the position by a magnetic catch 76 serving as a temporal fixing mechanism which temporality fixes the position determination holder 32A at the position. The temporal fixing mechanism may be a latch, leaf spring or the like other than the magnetic catch. Since the temporal fixing mechanism is provided, it may reduce the likelihood or prevent the position determination holder 32A from falling over to the left front side even more securely than the above-described structure.

Figure 24:
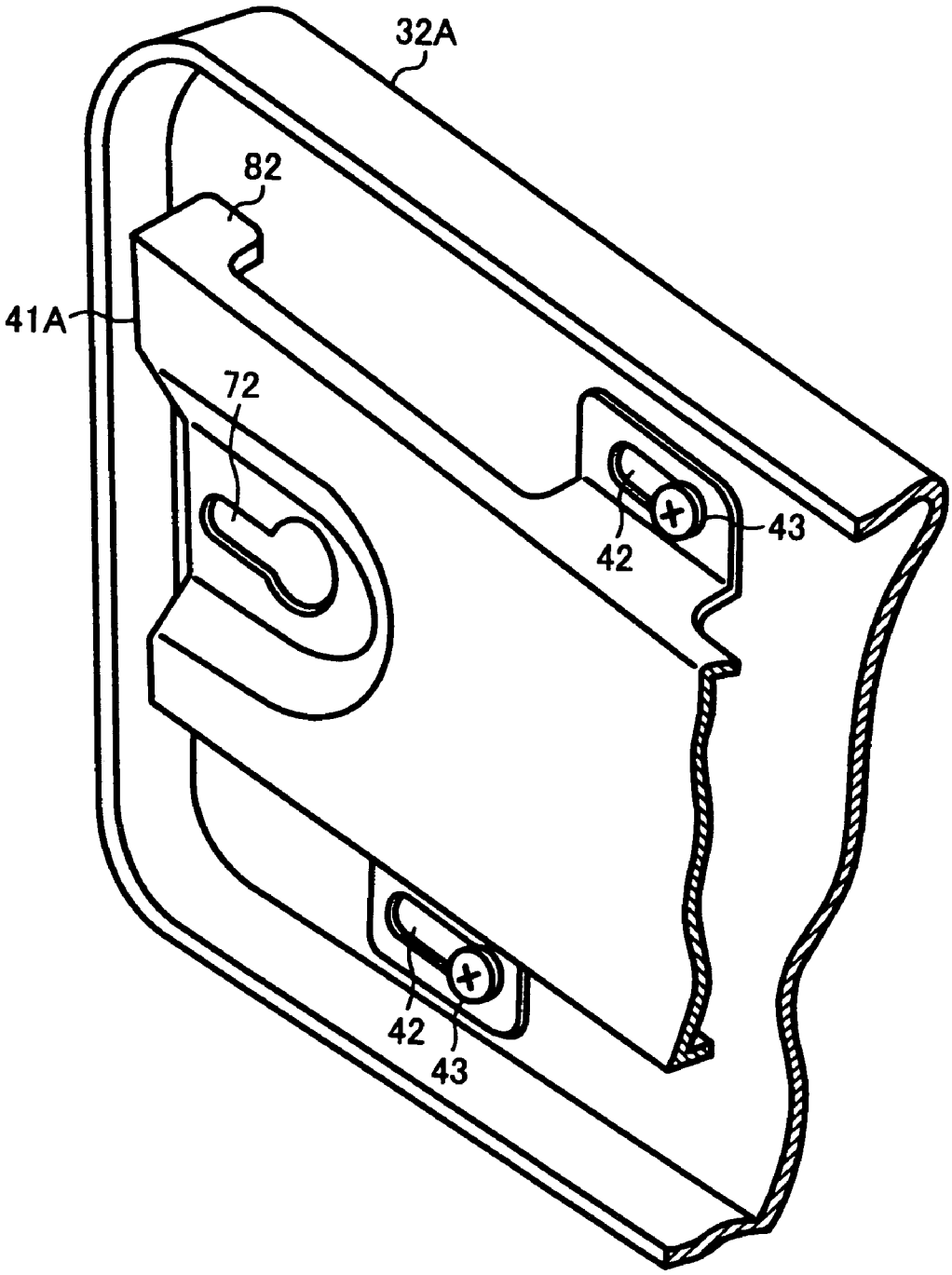
FIG. 24 is a perspective view of a structure for reducing or preventing a generation of wobbling motion around the position determining shaft.

As shown in FIG. 24, on the slide member 41A, a convex shape portion 82 is formed such that the height of the convex shape portion 82 corresponds to the web inner surface of the position determination holder 32A in the position determining shaft direction adjacent to the position determining shaft 74. Accordingly, in a case where the slide member 41A is moved to the secondary position, a wobbling motion due to looseness in the direction of the position determining shaft 74 may be reduced or prevented. In other words, it is preferred that the position determination holder 32A and the slide member 41A are configured such that there is no looseness in an area adjacent to the place where an engagement with the position determination shaft 74 takes place.

Figure 25:
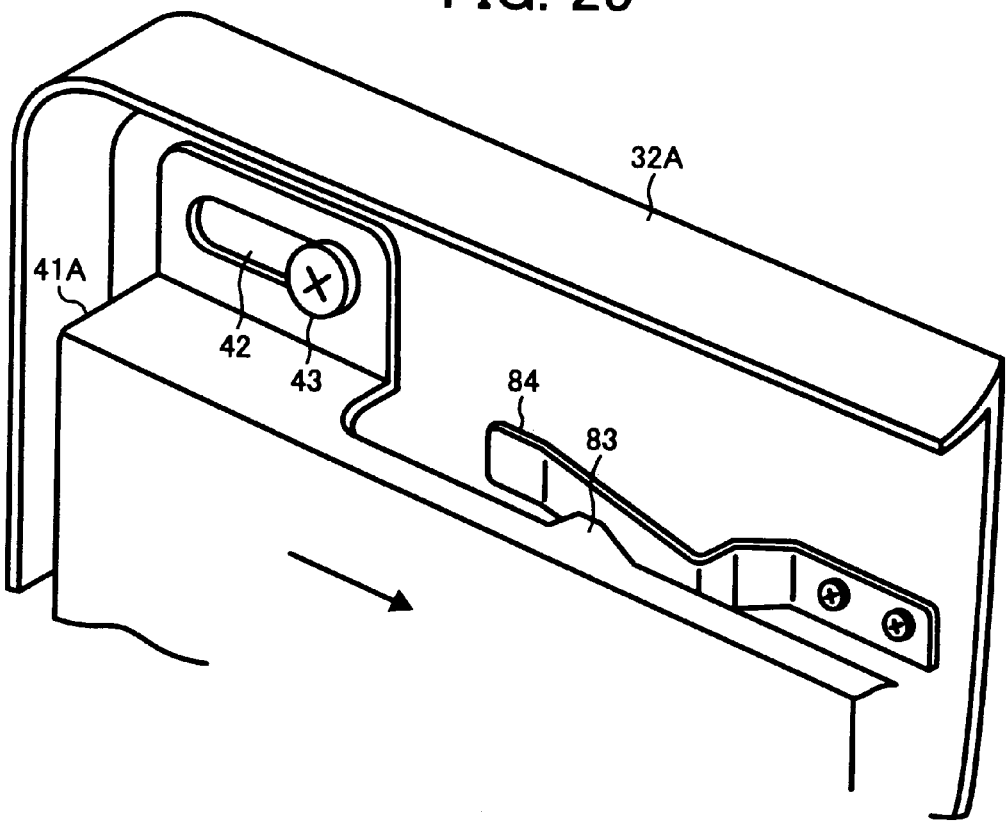
FIG. 25 is an enlarged perspective view of a structure for providing a click feeling when the slide member moves.

Next, a description is given of an example that operability associated with a moving operation of the slide member 41A is enhanced. As shown in FIG. 25, on the position determination holder 32A, an elastic member 84 is provided. On the slide member 41A, a claw shape 83 is formed at a position relative to the elastic member 84. For example, when the slide member 41A moves from the primary position to the secondary position, the elastic member 84 formed of a leaf spring and the claw shape 83 of the slide member 41A form a fitting-feeling providing mechanism. When the slide member 41A moves from the primary position to the secondary position, the claw shape 83 of the slide member 41A climbs over the elastic member 84, thereby providing the click feeling and enhancing operability.

Figure 26:
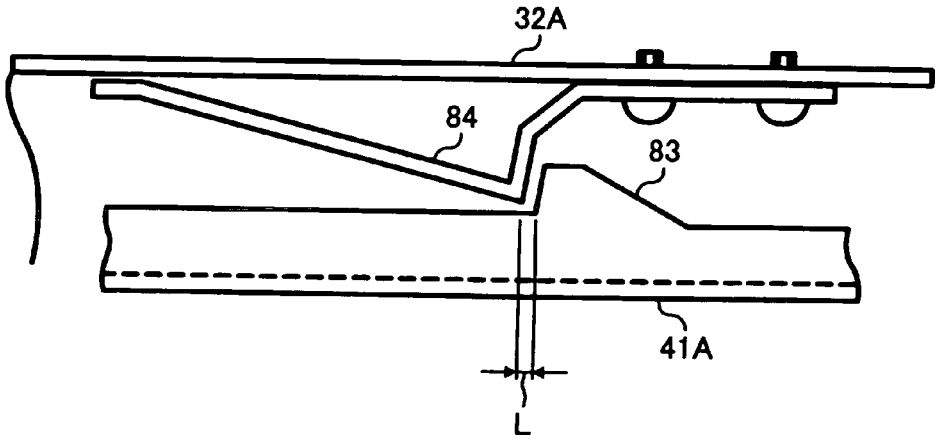
FIG. 26 is a plan view of FIG. 25.

As shown in FIG. 26, when the slide member 41A comes to the secondary position via the above-described fitting-feeling providing mechanism, a gap L between the elastic member 84 and the claw shape portion 83 is less than 2 mm. Accordingly, looseness in the horizontal direction of the slide member 41A is eliminated.

Figure 32:
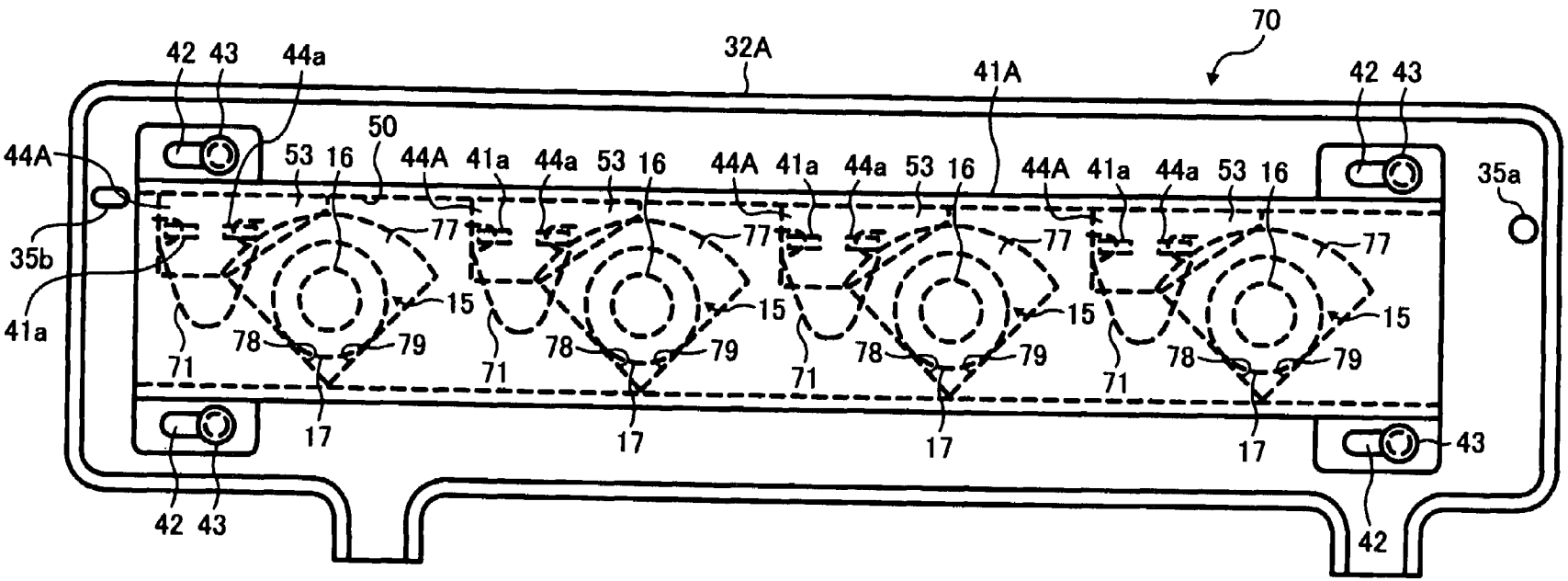
FIG. 32 is a front view of the position determining unit of FIG. 27 with the position determination holder at a closed position and the slide member at a primary position.
Figure 33:
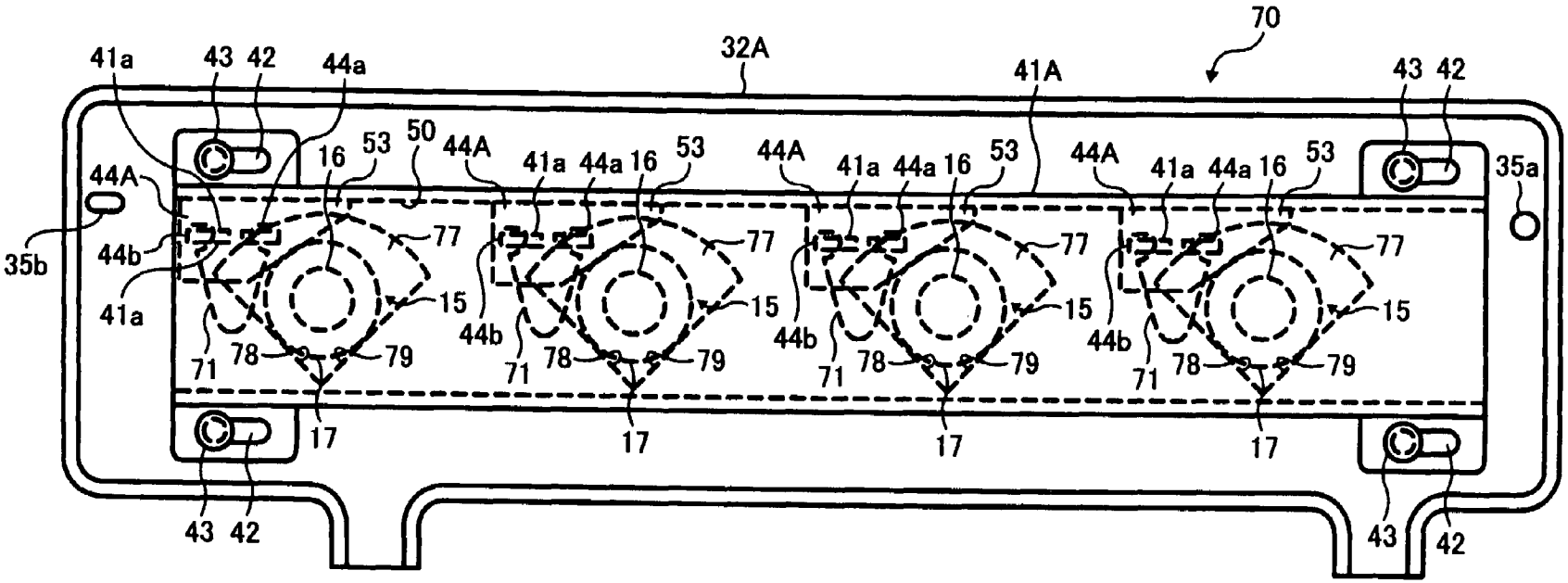
FIG. 33 is a front view of the position determining unit of FIG. 27 with the position determination holder at the closed position and the slide member at a secondary position.

With reference to FIGS. 32 and 33, a description is given of the operation of the position determining unit 70 of a first exemplary embodiment of the present invention, and supplementary explanations are provided with respect to the detailed structure as necessary, though some of them have been explained.

FIG. 32 illustrates, with reference to FIG. 3, a manner in which each of the process cartridges 1Y through 1BK are pressed into the back of the image forming apparatus main body, the position determination holder 32A is pivotally moved to the closed position, the position determining holes 35*a* and 35*b* formed therein are fitted with the position determining pins 36*a* and 36*b* provided in a protruding manner in the front plate 28 (refer to FIGS. 2 and 3), and the position determination holder 32A is positioned at the predetermined mounting position. Similarly to the comparative example, with reference to FIG. 2, the position determining unit 70 is seen in the arrow IV-direction in FIG. 32. As may be understood in FIGS. 32 and 33, the slide member 41A is provided on the position determination holder 32A. On the slide member 41A, a plurality of long elongated holes 42 are formed in the horizontal direction. The shoulder screws 43 are slidably inserted relative to each elongated hole 42, respectively, and each shoulder screws 43 are screwed on the position determination holder 32A. Accordingly, the slide member 41A is movably supported by the position determination holder 32A in the horizontal direction between the primary position shown in FIG. 32 and the secondary position shown in FIG. 33.

When the position determination holder 32A is swingablly moved from the open position to the closed position shown in FIG. 32, the shaft bearings 17 are inserted into each mounting hole 77 formed in the position determination holder 32A. As may be seen in FIG. 32, the size of each mounting hole 77 is configured to be larger than a cross sectional area of each shaft bearing 17. Thus each shaft bearing 17 is inserted into each mounting hole 77 with significant allowance. Therefore, each shaft bearing 17 may be easily inserted into each mounting hole 77. In the meantime, the pressure members 44A are provided corresponding to each shaft bearing 17, and are slidingly guided relative to the slide member 41A by the guide plate 50 and tab portions 41*a* fitted into elongated holes 44*b*, thereby making it possible to move for the predetermined strokes in a horizontal direction.

As previously described, each end portion of the U-shape springs 71 are latched on the tab portion 44*a* of each pressure member 44A and the tab portion 41*a* of the slide member 41A. Accordingly, a spring force is exerted to each pressure member 44A in the right direction. However, when the slide member 41A is at the primary position shown in FIG. 32, as shown in FIG. 10, due to the spring force of the spring 71, the base portion of the tab portion 41*a* of the slide member 41A comes into contact with the right end portion of the elongated hole 44*b* of each pressure member 44A, serving as a stopper. Thus, each pressure member 44A stops at the position shown in FIG. 32. At this time, each pressure member 44A does not come into contact with each shaft bearing 17 of each image carrier supporting member 15. In a state where the spring force is applied to each pressure member 44A by the spring 71, when the slide member 41A is at the primary position, each pressure member 44A on which the spring force is applied is controlled by each tab portion 41*a* provided on the slide member 41A, thereby reducing the likelihood or preventing the pressure member 44A from coming into contact with the image carrier supporting member 15. Accordingly, when the operator manually swings the position determination holder 32A to move from the above-described open position to the closed position shown in FIG. 32, each shaft bearing 17 may be fitted into each mounting hole 77 without interfering each pressure member 44A.

Subsequently, the operator turns the lever 90 shown in FIGS. 14 and 16 against the resultant force of the spring force of the four springs 71 and the frictional resistance of the slide-connecting portion of each pressure member 44A relative to the slide member 41A, so that the slide member 41A is slid to the right and positioned at the secondary position. Consequently, the wedge portion 53 of each pressure member 44A is pressed into a space between the guide plate 50 and the shaft bearing 17 of each image carrier supporting member 15. Then each shaft bearing 17 is pressed against two faces 78 and 79 which partition each mounting hole 77. The effect of the operation is described below.

When the slide member 41A is initiated to move from the primary position shown in FIG. 32 to the secondary position shown in FIG. 33, the spring force is exerted on the slide member 41A by each spring 71. Each pressure member 44A controlled by the tab portion 41*a* fitted into the elongated hole 44*b* starts to move to the right in FIG. 32 together with the slide member 41A. Subsequently, when the slide member 41A reaches the predetermined position between the primary and the secondary positions, the wedge portion 53 of each pressure member 44A, on which the spring pressure is exerted by each spring 71, is pressed into the space between the guide plate 50 and the shaft bearing 17 of each image carrier supporting member 15, pressed against the peripheral surface of each shaft bearing, and then stops. Accordingly, each pressure member 44A strenuously presses each shaft bearing 17 against the faces 78 and 79 of each mounting hole 77. When moving the slide member 41A to the secondary position against the spring force or the like of each spring 71 after each pressure member 44A stops, each end portion of the elongated hole 44*b* formed in each pressure member 44A is released from each tab portion 41*a*, thereby freeing each pressure member 44A from the control of each tab portion 41*a*.

As described above, according to the pressure force of the wedge portion 53 of each pressure member 44A to which the spring force is exerted by each spring 71, each shaft bearing 17 is pressed against the faces 78 and 79 of each mounting hole 77, thereby appropriately determining the position of each image carrier supporting member 15 and the front portion of each of the photoreceptor drums 6Y through 6BK supported by the position of each image carrier supporting member 15 with respect to the position determination holder 32A. At this time, with reference to FIGS. 2 and 3, the position of the position determination holder 32A is appropriately determined with respect to the frame 33. Therefore, the position of each of the photoreceptor drums 6Y through 6BK is also appropriately determined relative to the frame 33 of the image forming apparatus main body 7. When the operator installs the position determination holder 32A at the predetermined position with respect to the frame 33 and operates the lever 90 to move the slide member 41A, the position of the photoreceptor drums 6Y through 6BK may be determined with respect to the image forming apparatus main body 7. Moreover, the size of the mounting holes 77 formed in the position determination holder 32A may be configured much larger than the cross sectional area of the front end portion of the image carrier supporting member 15 so that each image carrier supporting member 15 may easily be fitted into each mounting hole 77.

As will be understood, the dimension accuracy of the position determination holder 32A relative to the frame 33, the pitch of the faces 78 and 79 of each mounting hole 77 of the position determination holder 32A and the dimension accuracy of each part are configured to be within the predetermined accuracy range or tolerance, in order to determine the position of the photoreceptor drums 6Y through 6BK relative to the image forming apparatus main body 7. As described above, the pressure mechanism is provided corresponding to each image carrier supporting member 15, and movably supports a plurality of pressure members 44 movable between a non-pressing position at which each image carrier supporting member 15 on each holding portion or the faces 78 and 79 does not come into contact and a pressing position at which each image carrier supporting member 15 thereon is pressed to determine the position. The pressure mechanism further movably supports the spring 71 serving as the spring force application mechanism which exerts the spring force on each pressure member 44A in a direction of the pressing position, and each pressure member 44A. Furthermore, the pressure mechanism is configured with the single slide member 41 movably supported by the position determination holder 32A between the primary position corresponding to the non-pressing position and the secondary position corresponding to the pressing position, and a travel mechanism 92 to move the slide member 41A between the primary and the secondary positions.

According to the first exemplary embodiment, by implementing above-described configuration, operability may be more enhanced than that of the comparative example, and cost reduction may be attained. In the first exemplary embodiment, the position and so forth of constituent elements will be set in order to carry out the following operations. In other words, when the slide member 41A is at the primary position, each pressure member 44A, on which the spring force is exerted by each U-shape spring 71, is controlled by each tab portion 41*a* serving as the stopper part of the slide member 41A, and is prevented from coming into contact with each image carrier supporting member 15 on the faces 78 and 79. When the slide member 41A moves from the primary position to the secondary position, the spring force is exerted on the slide member 41A by each U-shape spring 71, and each pressure member 44A controlled by each tab portion 41*a* moves together with the slide member 41A. Subsequently, when the slide member 41A comes to a position between the primary and the secondary positions, the wedge portion 53 of each pressure member 44A on which the spring force is exerted by each U-shape spring 71 is pressed into a space between the guide plate 50 and each image carrier supporting member 15 on the faces 78 and 79, and stops. Furthermore, the slide member 41A moves to the secondary position so that each pressure member 44A is released from the control of each tab portion 41*a*, and the position of the slide member 41A, each pressure member 44A, each U-shape spring 71 and each tab portion 41*a* is set.

According to the first exemplary embodiment, similarly to the above-described comparative example, when the slide member 41 is at the secondary position as shown in FIG. 33, the wedge portion 53 of each pressure member 44A is pressed into a space between the guide plate 50 and the peripheral surface of each shaft bearing 17. Due to the frictional force and the spring force of the spring 71, each image carrier supporting member 15 is held at a predetermined position, and the positions of the photoreceptor drums 6Y through 6BK are continuously and correctly determined. If the slide member 41A is manually returned again to the primary position as shown in FIG. 32, each pressure member is released from the peripheral surface of each shaft bearing 17. Therefore, the position determination holder 32A is swingablly moved to the open position shown in FIG. 3 without any difficulty. According to the exemplary embodiment of the present invention, an advantage and effect of the structure similar to the comparative example, are similar to that of the comparative example, except for the structure particularly to the exemplary embodiment of the present invention.

Figure 27:
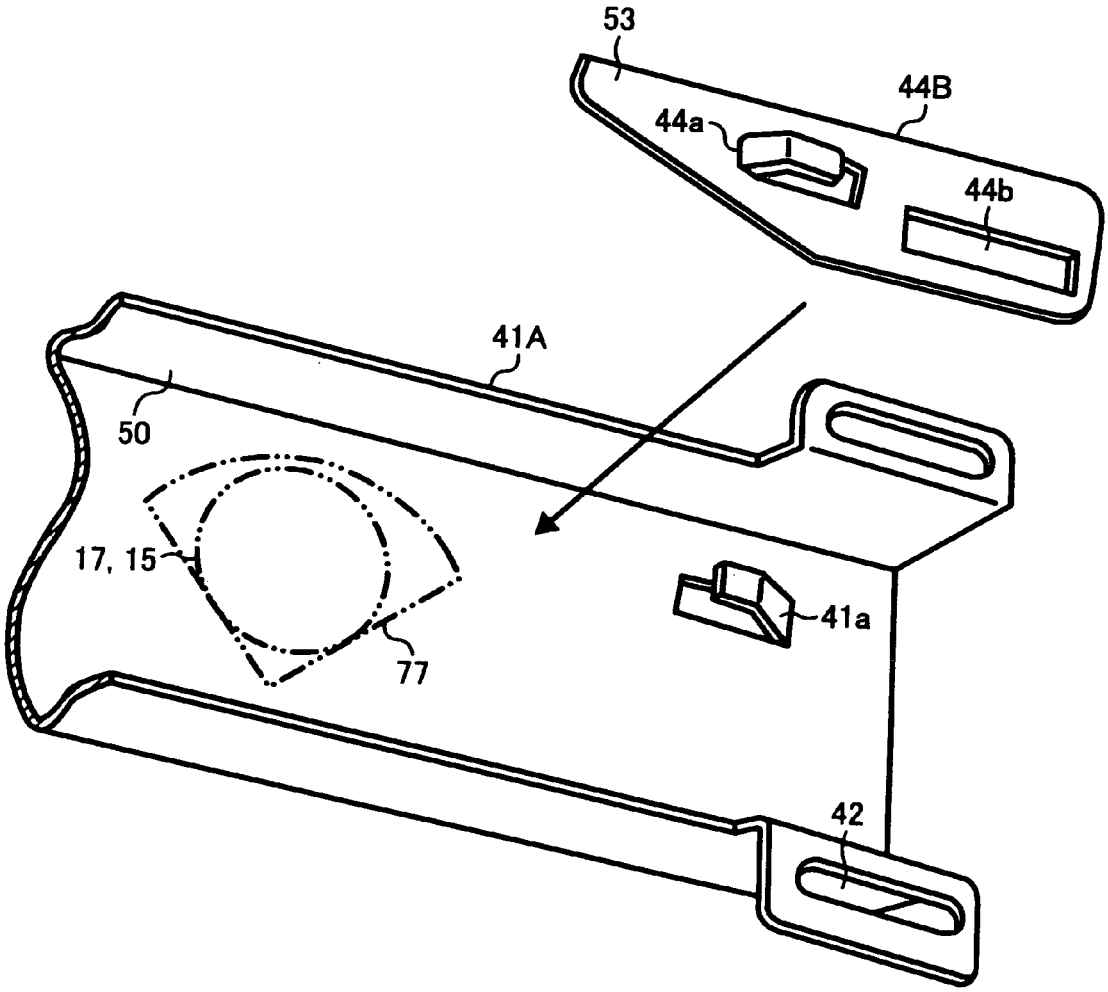
FIGS. 27, 28 and 29 are exploded perspective views and a perspective view for explaining a position determining unit of the color image forming apparatus according to another exemplary embodiment of the present invention.
Figure 28:
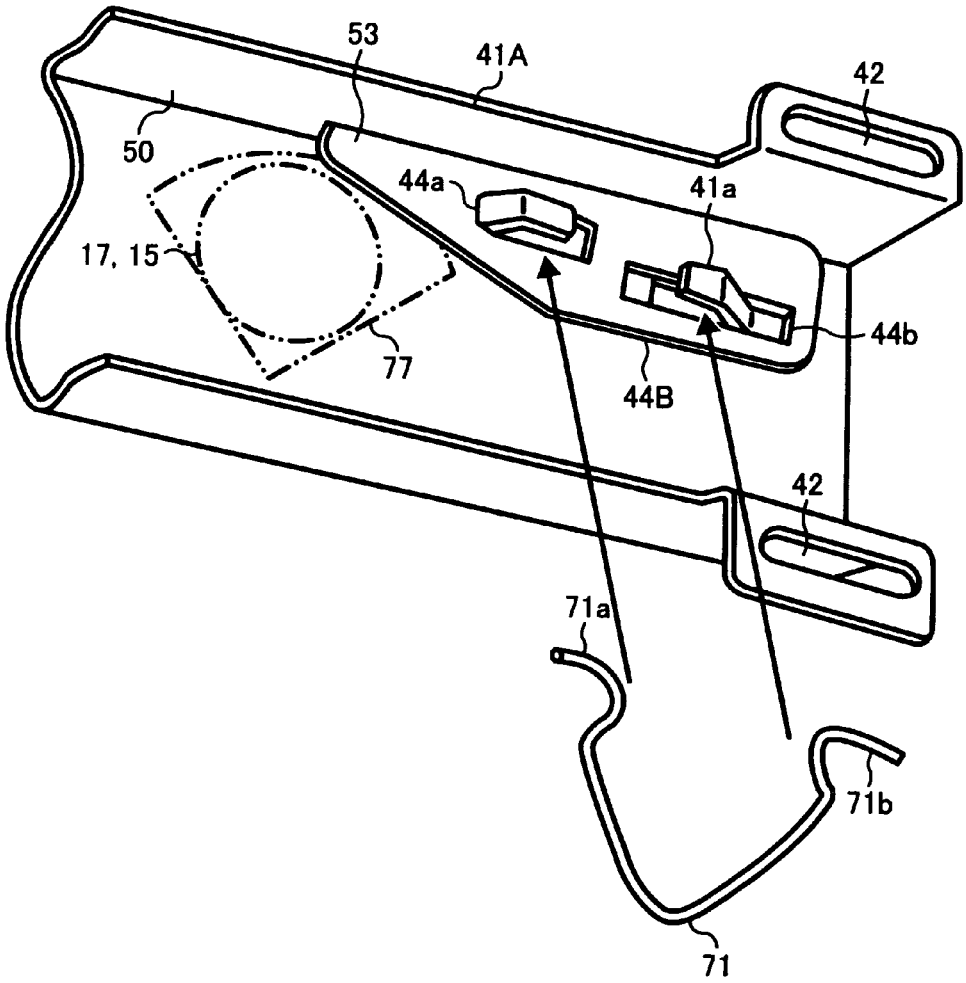
Figure 29:
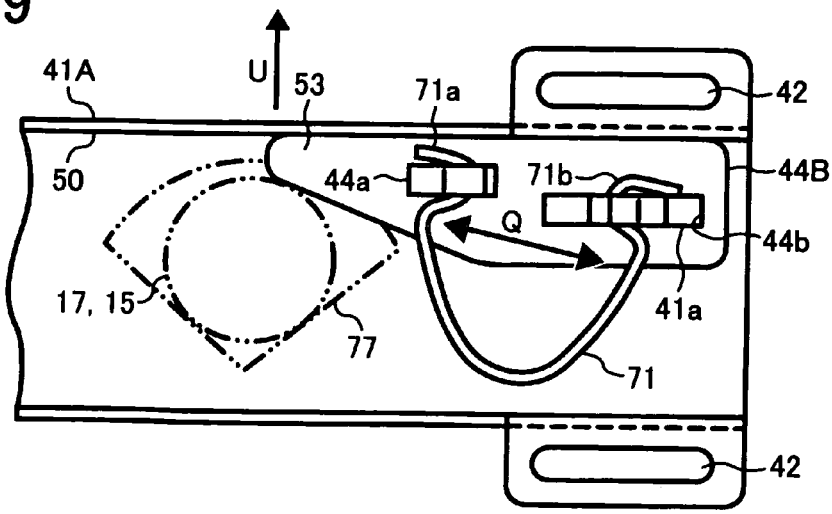

FIGS. 27 through 29 illustrate an example variation 1 of the first exemplary embodiment. When compared with the first exemplary embodiment, the example variation 1 has a structure which enhances a holding manner and slidability of the pressure member with the wedge portion 53. In other words, the difference is that the pressure member 44B is utilized instead of the pressure member 44A as the pressure mechanism, and other structures are similar to that of the first exemplary embodiment.

Similarly to the first exemplary embodiment, the slide member 41A which slides in the horizontal direction with respect to the position determination holder 32A which is not shown in FIGS. 27 through 29 is provided, and tab portions 41*a* serving as a primary locking part is formed on the slide member 41A. On each pressure member 44B having the tapered-shape wedge portion 53, the tab portions 44*a* and the elongated hole 44*b* serving as the second stopping portion facing an opposite direction of the tab portions 41*a* of the slide member 41A are formed. The slide member 41A and the pressure member 44B are engaged with each other as shown by an arrow in FIG. 27. The slide member 41A and the pressure member 44B are configured such that each of the tab portions 41*a* and 44*b* faces each other as shown in FIG. 28.

In a space between the tab portions 41*a* and 44*a*, both end portions 71*a* and 71*b* of each U-shaped spring 71 are hooked. By the elastic force of the spring 71, the pressure member 44B is held with respect to the slide member 41A, and tension is applied to a space between the pressure member 44B and the slide member 41A. The positional relationship between the tab portions 41*a* of the slide member 41A and the tab portions 44*a* of the pressure member 44B in a vertical direction indicates that the tab portions 44*a* of the pressure member 44B is at a position higher than the tab portions 41*a* of the slide member 41A relative to the wedge surface. FIG. 29 illustrates a state in which the slide member 41A, the pressure member 44B and the spring 71 are mounted. Since the tab portions portion 44*a* of the pressure member 44B is at a position higher than the tab portions portion 41*a* of the slide member 41A relative to the wedge surface, a force in an arrow D direction of FIG. 29 is applied so that the pressure member 44B comes into contact with the guide plate 50 of the slide member 41A, and the pressure member 44B is held at a stable position in the vertical direction.

Figure 30:
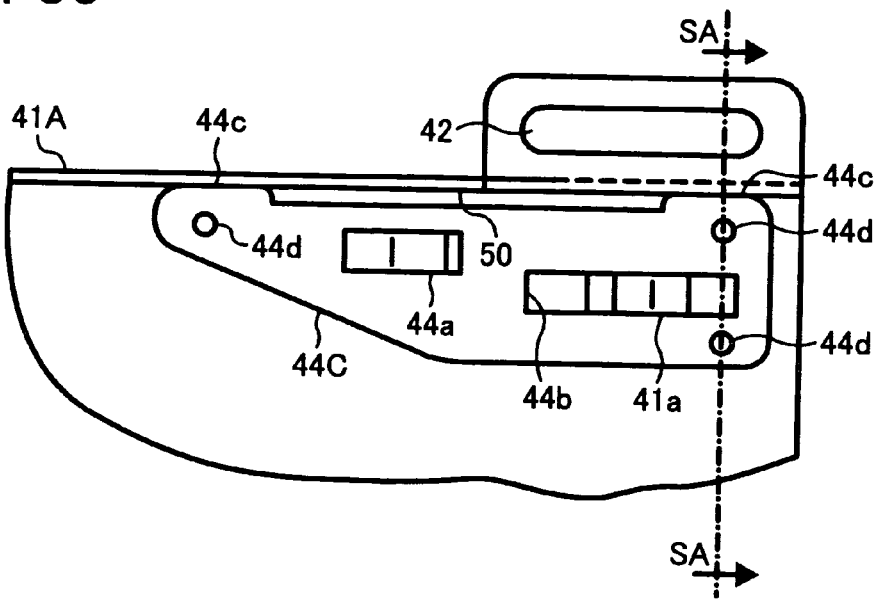
FIG. 30 is a front view for further explaining the position determining unit of FIG. 27.
Figure 31:
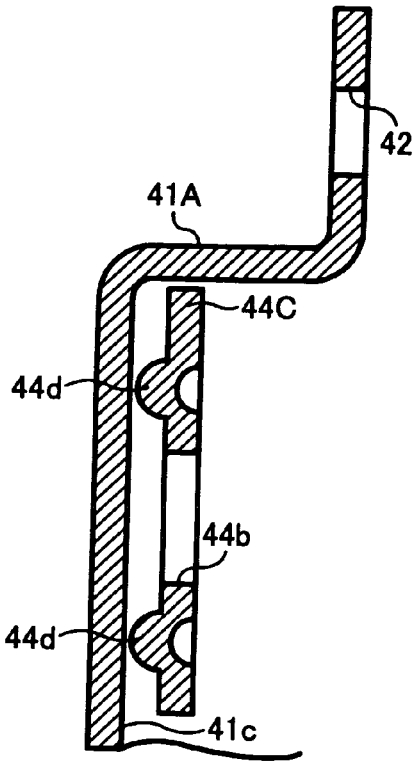
FIG. 31 is a cross sectional view taken along line SA-SA in FIG. 30.

FIGS. 30 and 31 illustrates an example variation 2 of the example variation 1. When compared with the example variation 1, the example variation 2 utilizes the pressure member 44C instead of the pressure member 44B. Unless otherwise specified, other elements are similar to the example variation 1.

The contact part of the guide plate 50 of the slide member 41A of the pressure member 44C is in contact with the upper end portions of the pressure member 44C. Accordingly, the contact area of the pressure member 44C and the slide member 41A is small, so that the friction at a time when the pressure member 44C moves in the vertical direction is reduced. As shown in FIG. 30, the shape of the upper end portions of the pressure member 44C has a linear shape 44*c*, not a circular shape. Therefore, with reference to FIG. 29, for example, even if the slide member 41A slides in the horizontal direction, and the force in an arrow U-direction is generated when the pressure member 44C presses the shaft bearing 17 of the photoreceptor drum, because the contact part of the pressure member 44C has a linear shape, the pressure member 44C does not penetrate into the guide plate 50 of the slide member 40A, thereby smoothly moving the pressure member 44C. Furthermore, as shown in FIGS. 30 and 31, on the pressure member 44C, more than three projections 44*d* having a circular shape are formed. Accordingly, the projections 44*d* are in contact with the web surface 41C of the slide member 41A in a point-contact manner so that it is made possible to smoothly move the pressure member 44C with respect to the slide member 41A.

Figure 34:
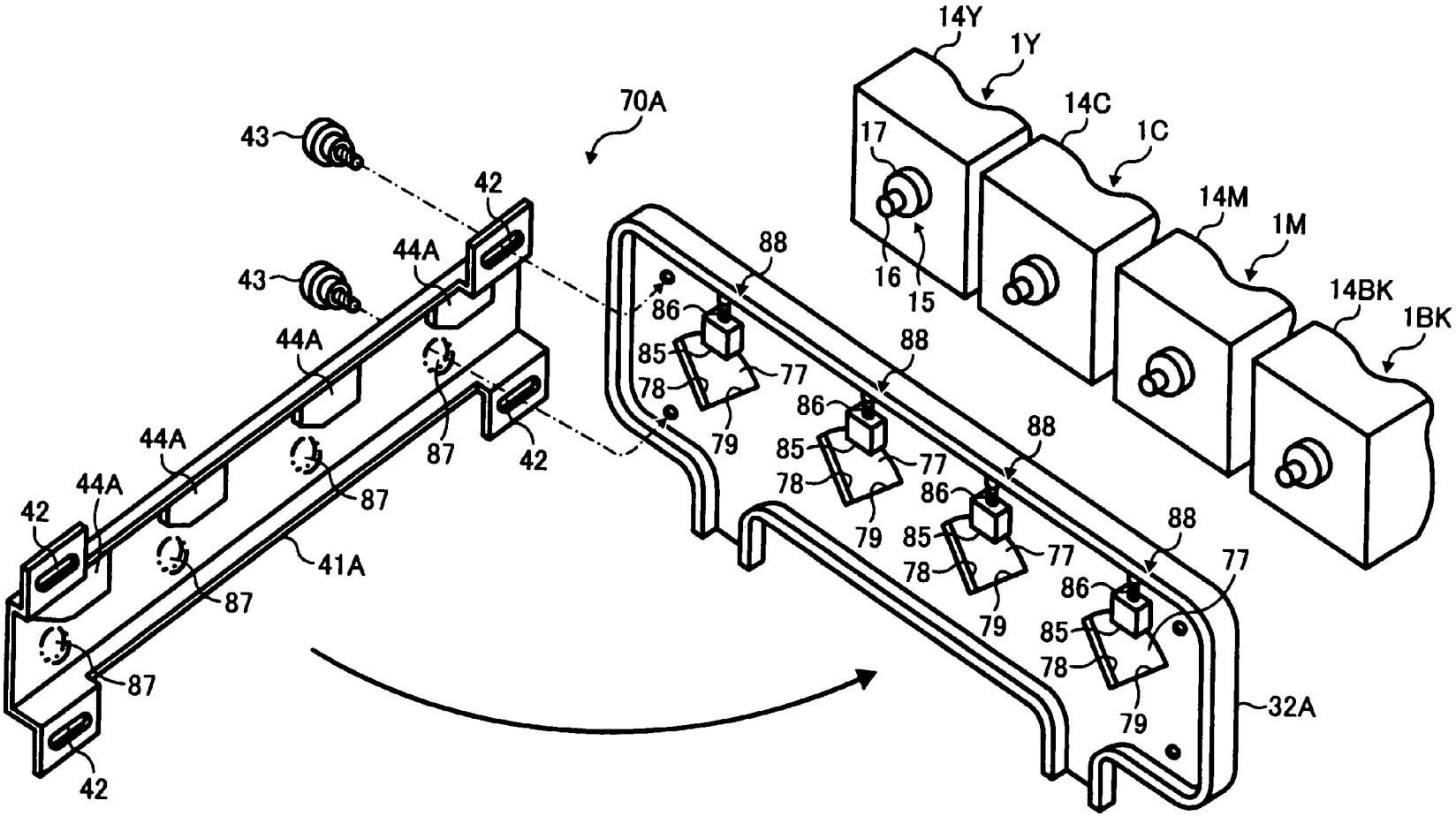
FIG. 34 is an exploded perspective view for explaining a position determining unit of the color image forming apparatus according to another exemplary embodiment of the present invention.

FIG. 34 illustrates an example variation 3 of the first exemplary embodiment of the present invention. When compared with the first exemplary embodiment shown in FIGS. 8 through 26, and FIGS. 32 and 33, in the example variation 3, a plurality of pressure mechanisms 88 are disposed on the position determination holder 32A side, and unless otherwise specified, other elements are similar to that of the first exemplary embodiment. The pressure mechanisms 88 press down each shaft bearing 17 in a downward direction or an almost vertical direction such that each shaft bearing 17 may directly contact with the faces 78 and 79. A state in which the shaft bearing 17 of each image carrier supporting member 15 is held onto each of the faces 78 and 79 of each mounting member 77, that is, a state in which each image carrier supporting member is held on the holding portion in the opening of the holder, refers to an initial setting state in which the slide member is at the primary position before an operation of moving the slide member to the secondary position.

The pressure mechanisms 88 are provided at four places corresponding to the four mounting holes 77, respectively, and configured with pressure members 85 touchable to each shaft bearing 17, and compression springs 86 serving as elastic members (spring application mechanisms) for exerting the spring force on the pressure members 85 in the downward vertical direction toward the shaft bearings 17. It is desirable to form a slant or a round or R-chamfered surface on the surface of each pressure member 85 on which the shaft bearings 17 come into contact, such that when each shaft bearing 17 of the process cartridges 1Y through 1BK is set or held on the faces 78 and 79 of each mounting hole 77, the pressure members 85 will not be caught by the shaft bearings 17 and damage functions thereof. It is desirable to form the pressure members 85 by resins or metals, for example, polyacetal resin (POM) having an appropriate strength, abrasion resistance and so forth. One end of each compression spring 86 is locked and fixed on the upper end of each pressure member 85, and the other end of each compression spring 86 is locked and fixed on the bottom surface of the upper flange wall of the position determination holder 32A. On the upper portion of the position determination member 32A, one end of each compression spring 86 is locked. On the upper portion of each pressure member 85, a not shown protruding part for controlling bowing of the compression spring 86 is integrally formed.

Escape holes 87 indicated by the dash-double dotted line in the slide member 41A are formed to reduce the likelihood or prevent the slide member 41A from an interference with each supporting shaft 16 of the process cartridges 1Y through 1BK. The escape holes 87 are necessary elements for later-described example variations 5 and 6. However, if the protruding length of the supporting shafts 16 from the shaft bearings 17 of the image carrier supporting members 15, for example, is short enough so that the protruding portion of the supporting shafts 16 does not interfere with the slide member 41A, the escape holes 87 may be eliminated.

In FIG. 34, a reference numeral 70A indicates the position determining unit formed of the position determination holder 32A in which the pressure mechanisms 88 are disposed, slide member 41A and so forth. When the position determining unit 70A is swingablly moved and mounted onto the front plate 28 of the image forming apparatus main body 7 with reference to FIG. 2, the pressure members 85 on which the spring force is exerted by each compression spring 86 come into contact with each shaft bearing 17 of the process cartridges 1Y through 1BK, and each shaft bearing 17 is pressed down by the elastic force thereof. Accordingly, each shaft bearing 17 is evenly pressed down to each of the faces 78 and 79. Therefore, according to the example variation 3, each shaft bearing 17 of the process cartridges 1Y through 1BK is surely and evenly pressed against the faces 78 and 79 of each mounting hole 77 by each pressure mechanism 88 disposed on the position determination holder 32A, and positional accuracy of each supporting shaft 16 may be secured.

Figure 35:
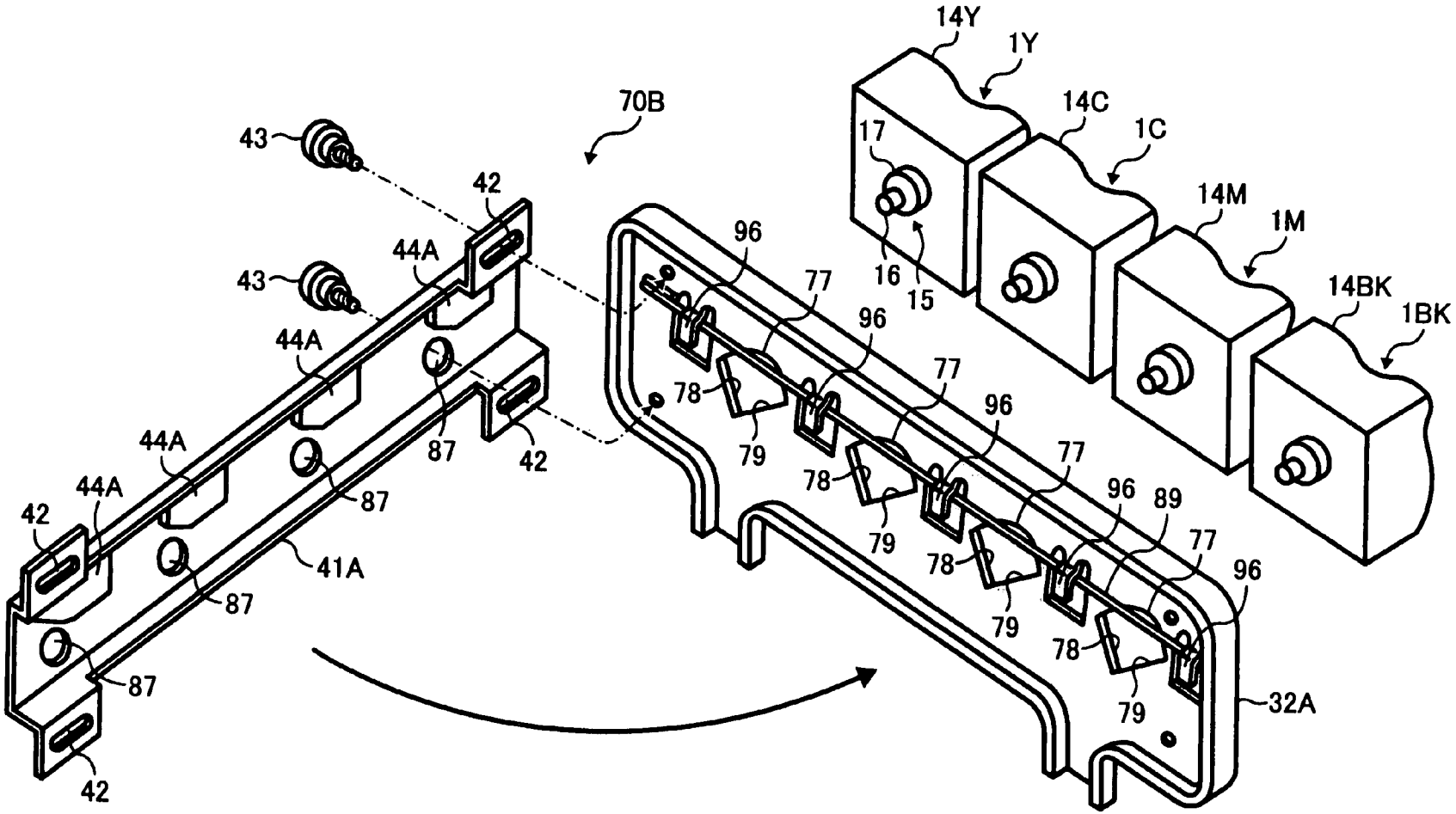
FIGS. 35 and 36 are an exploded perspective view and a cross sectional view for explaining a position determining unit of the color image forming apparatus according to another exemplary embodiment of the present invention.
Figure 36:
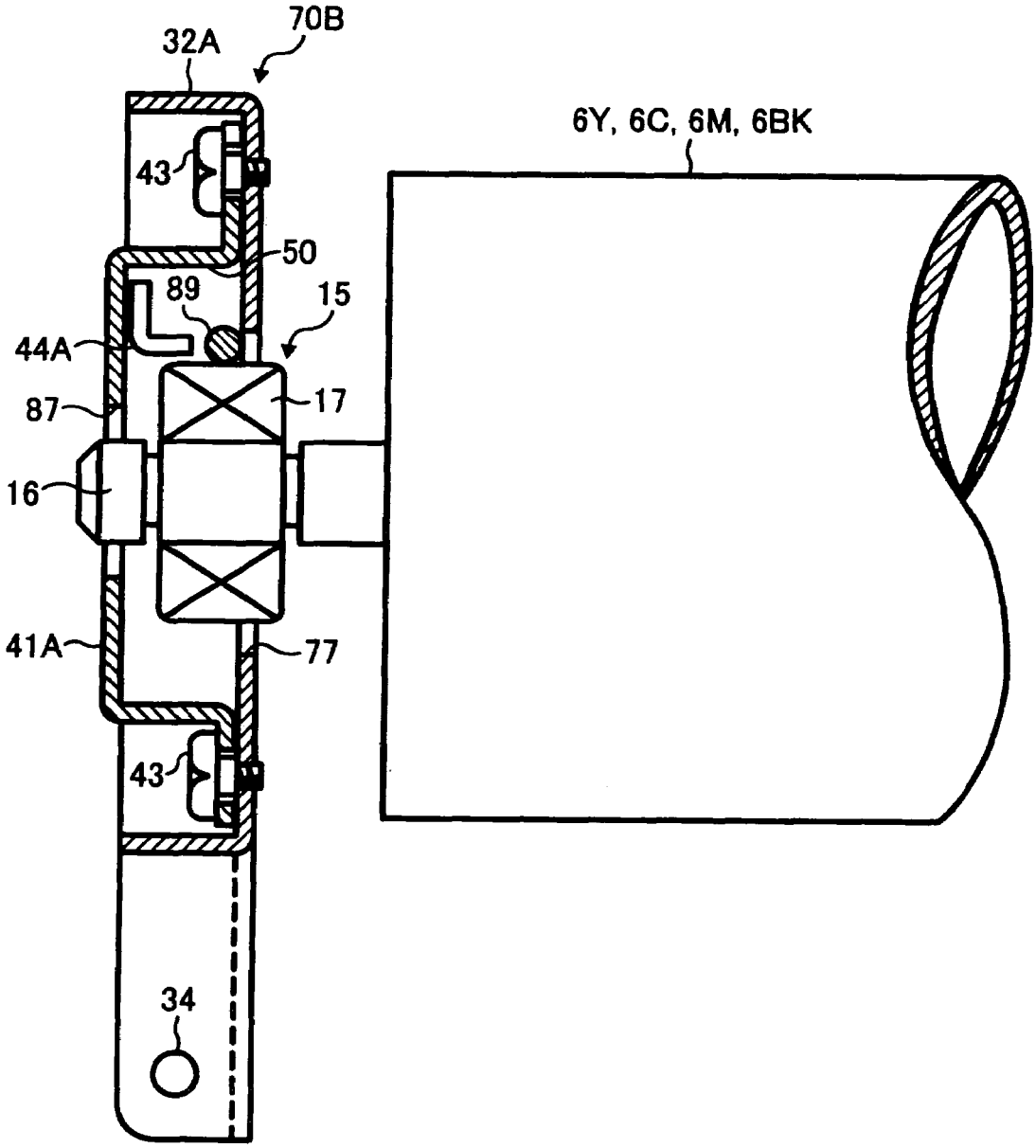

FIGS. 35 and 36 illustrate an example variation 4 of the example variation 3. When compared with the example variation 3 shown in FIG. 34, in the example variation 4, a wire 89 which is an elastic linear member is disposed on the position determination holder 32A such that when each shaft bearing 17 of each image carrier supporting member 15 of the process cartridges 1Y through 1BK is held on each of the faces 78 and 79, the wire 89 serves as a pressure mechanism for pressing down each shaft bearing 17 in a downward direction or an almost downward vertical direction to directly contact with the faces 78 and 79. Unless otherwise specified, other elements are similar to the example variation 3.

The wire 89 is disposed near an upper portion of each mounting hole 77 of the position determination holder 32A. In a space between both end portions of the position determination holder 32A and each mounting hole 77, a tab portion 96 for supporting and latching the wire 89 is formed at five places. As the wire 89, for example, a metal elastic material such as a piano wire, stainless steel, or spring copper wire may be utilized. However, as long as it is linear or cordage that may restore its elasticity or satisfy desired endurance, resin material or any other suitable material may be used. In the example variation 4, five tab portions 96 are provided corresponding to the four process cartridges 1Y through 1BK, or the four photoconductive drums 6Y through 6BK. However, the number of tab portions 96 may be changed depending upon the number of the process cartridges or the photoconductive drums. Moreover, though it is not shown, on the position determination holder 32A, protrusions or the like for reducing the likelihood or preventing the wire 89 from falling are integrally formed.

FIGS. 35 and 36 illustrate a position determining unit 70B formed of the position determination holder 32A on which the wire 89 is disposed in a manner described above, the slide member 41A and so forth. As shown in FIG. 36, when the position determining unit 70B is swingablly moved and mounted on the front plate 28 of the image forming apparatus main body 7 with reference to FIG. 2, the wire 89 first comes into contact with each shaft bearing 17 of the process cartridges 1Y through 1BK, and then each shaft bearing 17 is pressed down by the elastic force of the wire 89. Accordingly, each shaft bearing 17 is evenly pressed down against the faces 78 and 79 of each mounting hole 77.

Therefore, according to the example variation 4, due to the elastic force of the wire 89 disposed on the position determination holder 32A, each shaft bearing 17 of the process cartridges 1Y through 1BK is surely and evenly pressed against the faces 78 and 79 of each mounting hole 77 so that positional accuracy of each supporting shaft 16 may be secured.

With reference to FIG. 34, for example, the pressure mechanism may be other than the pressure mechanism 88, and the pressure mechanisms 88 may be eliminated. The pressure mechanism may be such that when the shaft bearing 17 of each image carrier supporting member 15 is held on the faces 78 and 79, the base portion of pressure members formed of elastic leaf springs having a U-shape when seen from the side is fixed on the bottom surface of the upper flange wall of the position determination holder 32A, and the free end portions press down each shaft bearing 17 in the vertical downward direction so that each shaft bearing 17 directly comes into contact with the faces 78 and 79. In other words, the pressure mechanism according to an exemplary embodiment of the present invention may be any mechanism which has a relatively simple configuration and can surely and evenly press image carrier supporting members onto a holding portion.

Figure 37:
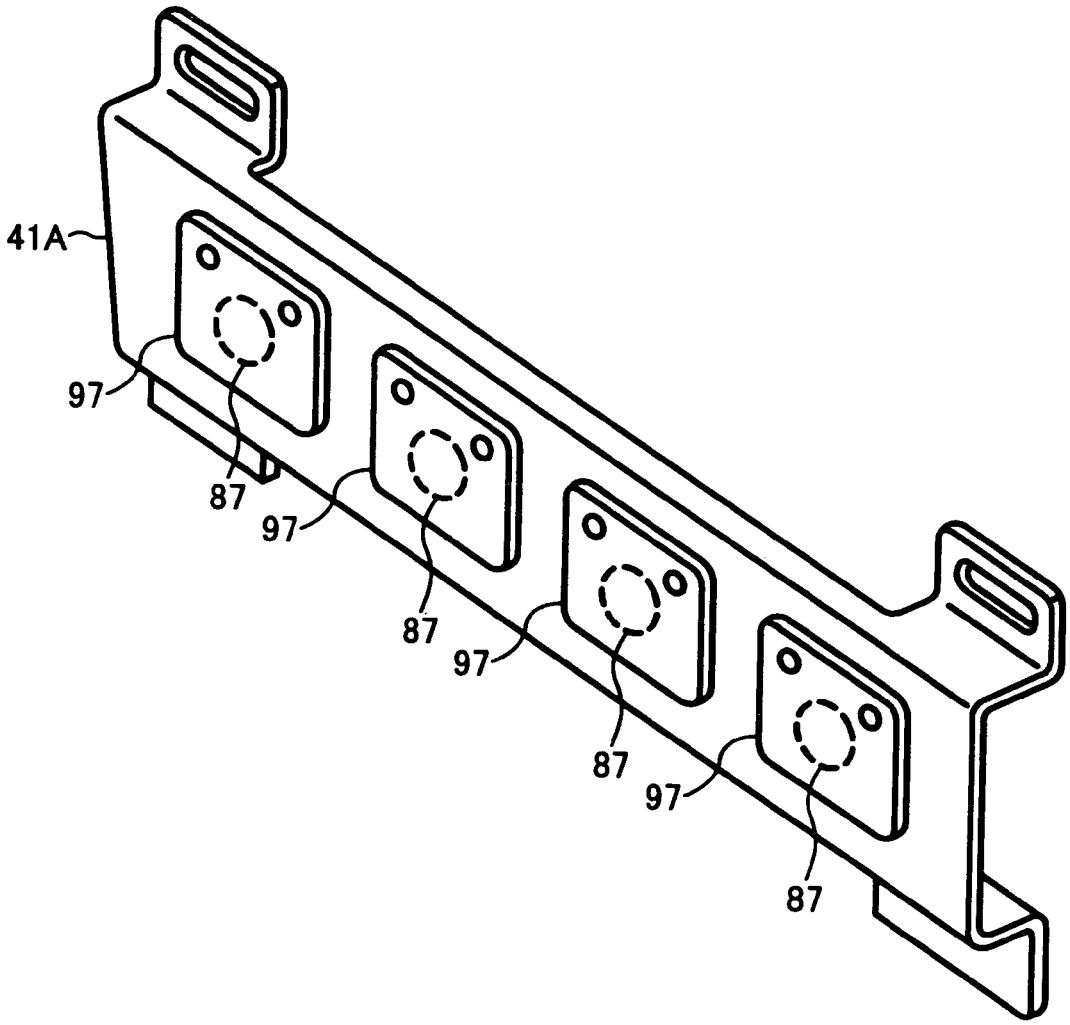
FIGS. 37 and 38 are a perspective view and a cross sectional view for explaining a position determining unit of the color image forming apparatus according to another exemplary embodiment of the present invention.
Figure 38:
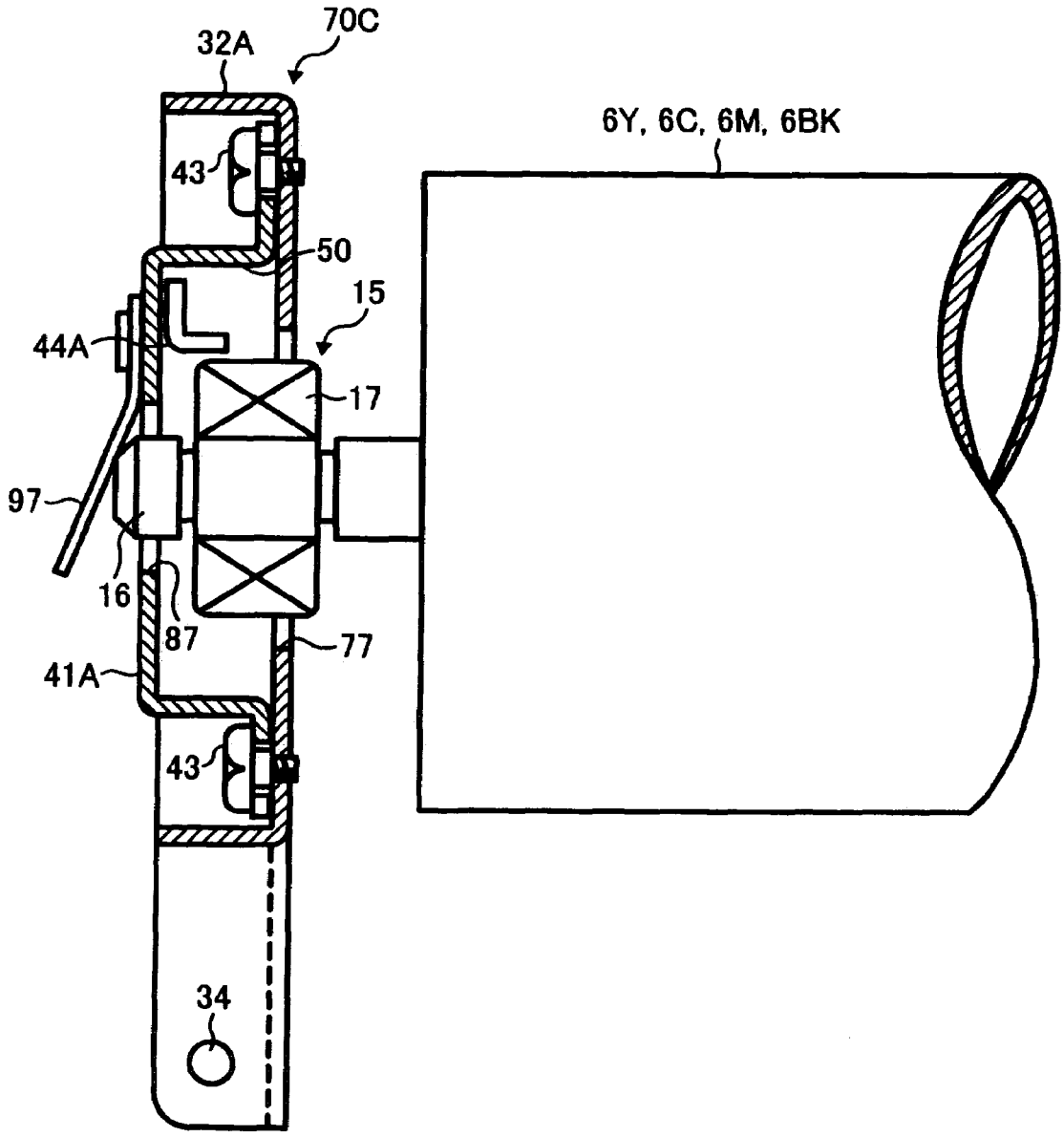

FIGS. 37 and 38 illustrate an example variation 5 of the first exemplary embodiment. When compared with the first exemplary embodiment shown in FIGS. 8 through 26, and FIGS. 32 and 33, in the example variation 5, leaf springs 97 which are in a form of elastic sheet member are disposed on the slide member 41A such that when each shaft bearing 17 of each image carrier supporting member 15 of the process cartridges 1Y through 1BK is held on each of the faces 78 and 79, the leaf springs 97 serve as a pressure mechanism for pressing down each shaft bearing 17 in a downward direction or an almost downward vertical direction to indirectly contact with the faces 78 and 79. Unless otherwise specified, other elements are similar to the first exemplary embodiment.

The leaf springs 97 are in a form of a rectangular flat plate, and one end portion thereof is fixed by swaging, bolting or welding, to the slide member 41A positioned higher than the supporting shafts 16. The other end portion of the leaf springs, which is a free end, is disposed so as to press onto the upper part of the supporting shaft 16. In the slide member 41A, four escape holes 87 are formed so that each supporting shaft 16 may be inserted without interference. The diameter of each escape hole 87 is configured to be large enough to avoid interference with each supporting shaft 16, when the slide member 41A slides back and forth between the primary and the secondary positions. Each leaf spring 97 is configured to be large enough to cover each escape hole 87.

FIG. 38 illustrates a position determining unit 70C formed of the slide member 41A on which the leaf springs 97 are disposed, and the position determination holder 32A. As shown in FIG. 38, when the position determination unit 70C is swingablly moved and mounted onto the front plate 28 of the image forming apparatus main body 7 with reference to FIG. 2, each image carrier supporting member 15 of the process cartridges 1Y through 1BK is first inserted through each mounting hole 77 of the position determination holder 32A, and then each supporting shaft 16 is inserted through each escape hole 87 of the slide member 41A and comes into contact with each leaf spring 97. Accordingly, due to the elastic force or the spring force thereof, each shaft bearing 17 is pressed down together with each supporting shaft 16, and is evenly pressed against the faces 78 and 79 of each mounting hole 77.

Therefore, according to the example variation 5, due to the elastic force of the leaf springs 97 serving as the pressure mechanism, each shaft bearing 17 of the process cartridges 1Y through 1BK is surely and evenly pressed against the faces 78 and 79 of each mounting hole 77 so that positional accuracy of each supporting shaft 16 may be secured. Furthermore, the leaf springs 97 are configured to be larger than the escape holes 87 of the slide member 41A, and are installed so as to cover the escape holes 87. Consequently, even if an user mistakenly sticks his/her finger into the mounting holes 77 of the position determination holder 32A, it is possible for the user to avoid touching the end surface of the leaf springs 97, thereby reducing the likelihood or preventing his/her finger from getting hurt.

Figure 39:
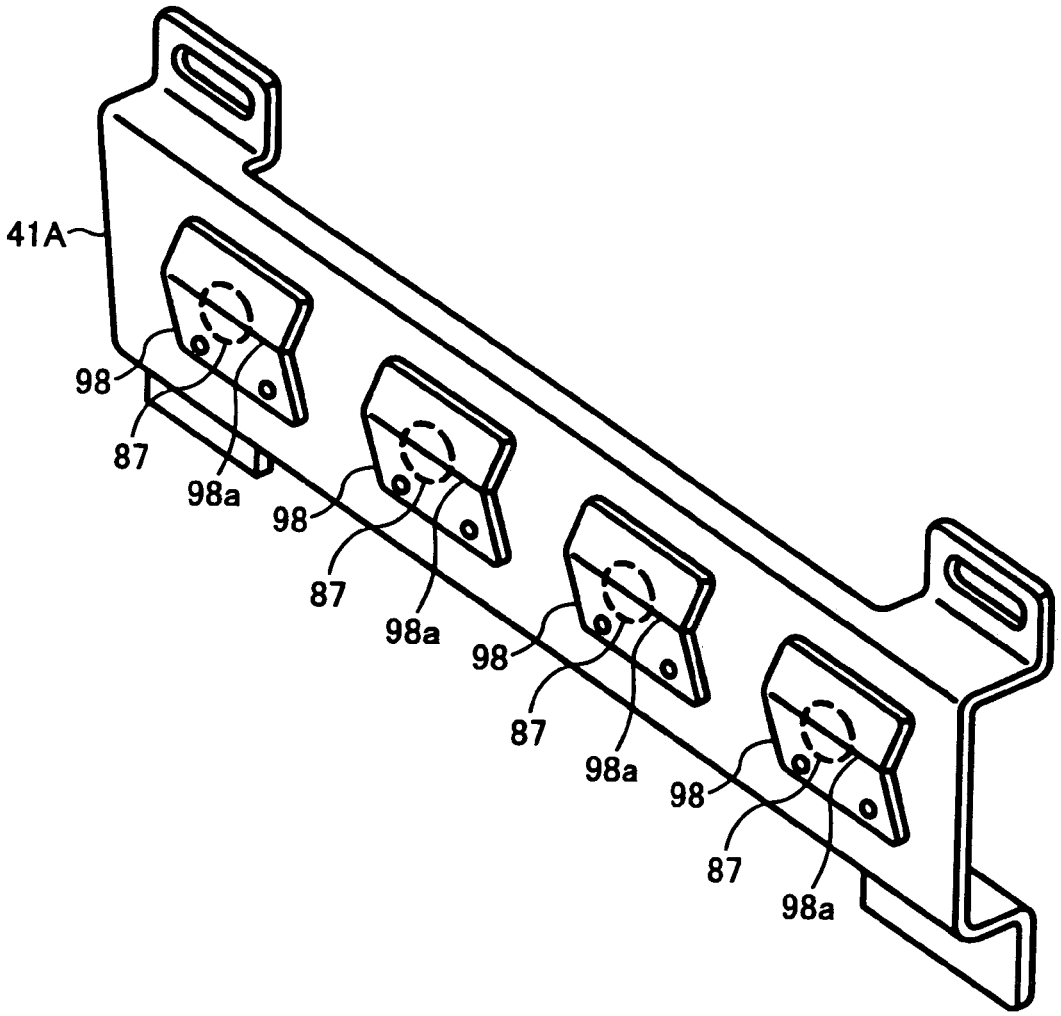
FIGS. 39 and 40 are a perspective view and a cross sectional view, respectively, for explaining a position determining unit of the color image forming apparatus according to another exemplary embodiment of the present invention.
Figure 40:
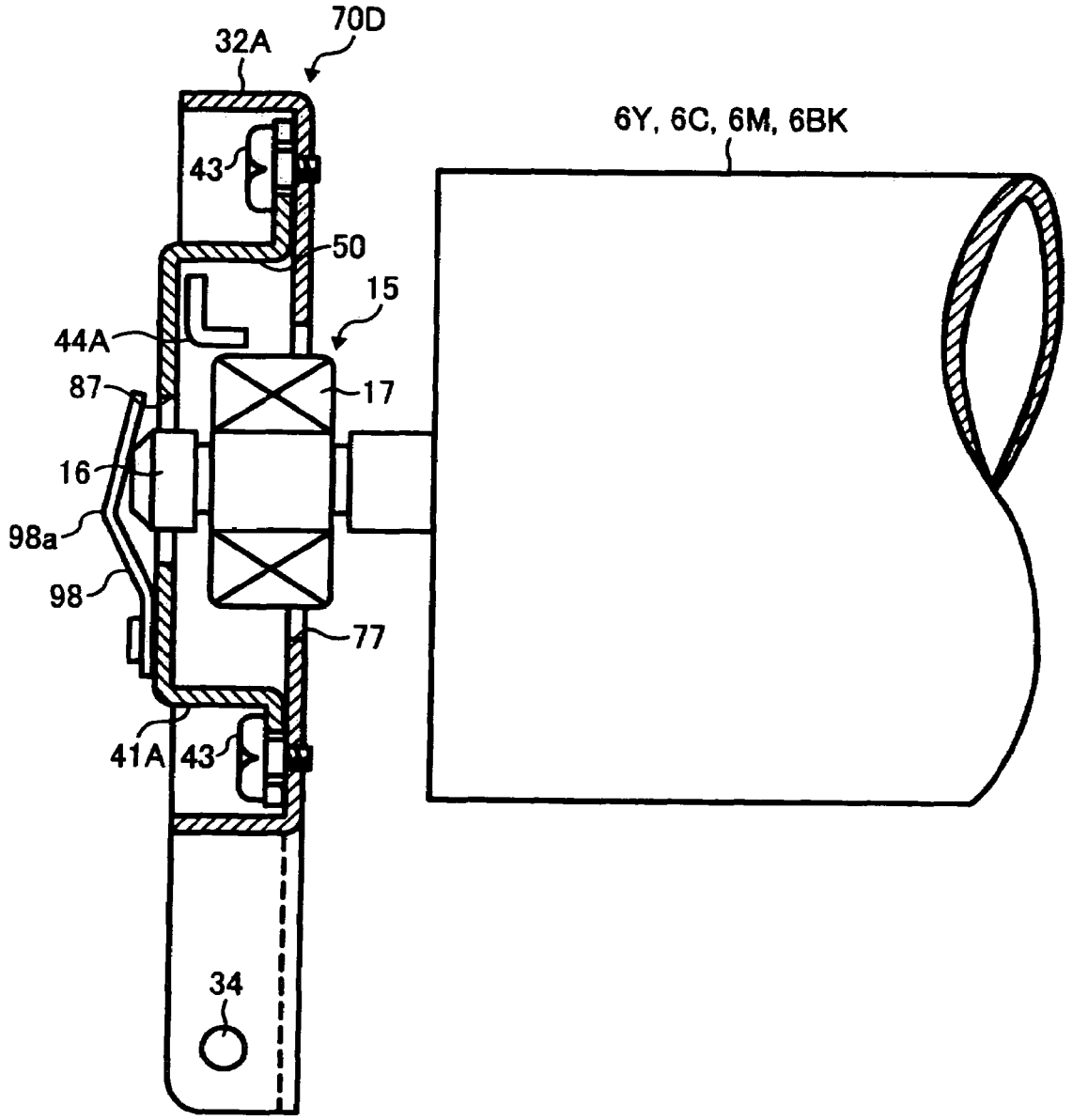

FIGS. 39 and 40 illustrate an example variation 6 of the example variation 5. When compared with the example variation 5 shown in FIGS. 37 and 38, in the example variation 6, leaf springs 98 which serve as a pressure mechanism, instead of the leaf springs 97, in which the mounting position and shape relative to the slide member 41A are modified, and are in a form of elastic sheet member, are disposed on the slide member 41A. Unless otherwise specified, other elements are similar to that of the example variation 5.

One end portion of the leaf springs 98, which is the base portion, is secured to the slide member 41A positioned below each supporting shaft 16 in a similar manner as the example variation 5, and a bent-shape 98*a* is formed below the center position of each supporting shaft 16 on each leaf spring 98. The other end portion of the leaf spring 98, which is a free end, is disposed so as to press against the upper portion the supporting shaft 16. Similarly to the example variation 5, each leaf spring 98 is configured to be large enough to cover each escape hole 87 of the slide member 41A.

FIG. 40 illustrates a position determination unit 70D formed of the slide member 41A on which the leaf springs 98 are disposed, and the position determination holder 32A. As shown in FIG. 40, when the position determination unit 70D is swingablly moved and mounted onto the front plate 28 of the image forming apparatus main body 7 with reference to FIG. 2, each image carrier supporting member 15 of the process cartridges 1Y through 1BK is first inserted through each mounting hole 77 of the position determination holder 32A, and then each supporting shaft 16 is inserted through each escape hole 87 of the slide member 41A and comes into contact with each leaf spring 98. Accordingly, due to the elastic force or the spring force thereof, each shaft bearing 17 is pressed down together with each supporting shaft 16, and is evenly pressed against the faces 78 and 79 of each mounting hole 77.

Therefore, according to the example variation 6, due to the elastic force of the leaf springs 98 serving as the pressure mechanism, each shaft bearing 17 of the process cartridges 1Y through 1BK is surely and evenly pressed against the faces 78 and 79 of each mounting hole 77 so that positional accuracy of each supporting shaft 16 may be secured. Furthermore, the leaf springs 98 are configured to be larger than the escape holes 87 of the slide member 41A, and are installed so as to cover the escape holes 87. Consequently, even if an user mistakenly sticks his/her finger into the mounting holes 77 of the position determination holder 32A, it is possible for the user to avoid touching the end surface of the leaf springs 98, thereby reducing the likelihood or preventing his/her finger from getting hurt.

The above-described exemplary embodiments are explained with reference to a tandem-type image forming apparatus which transfers images to a sheet-type recording medium after transferring the images to an intermediate transfer body. The above-described exemplary embodiments may be allied to a tandem-type color image forming apparatus using a direct transfer method in which images are sequentially transferred onto a sheet-type recording medium conveyed by an endless belt as a recording medium conveying mechanism. An example is shown in FIG. 1 in Japanese Patent Laid-Open Publication No. JP 11-95565.

This invention is not limited to image forming apparatuses, and may be implemented in position determining units and position determining methods for rotating units of various devices. The protruding portion refers to conceptual meaning, such as rotating shafts of the rotation unit, shaft bearings, supporting shafts and so forth.

Numerous additional modifications and variations are possible in light of the above teachings. It is therefore to be understood that within the scope of the disclosure this invention may be practiced otherwise than as specifically described herein.

What is claimed is:

1. An image forming apparatus, comprising:

an image carrier unit including an image carrier, and a supporting member for supporting the image carrier, the image carrier unit being configured to be detachably installed in the image forming apparatus and to form a toner image on a surface of the image carrier;

a position determining unit including a holding member having an opening for receiving the supporting member of the image carrier unit, the opening having a predetermined shape to sustain a weight of the image carrier unit through the supporting member in a vertical direction and to grip the supporting member in a horizontal direction; and a pressure mechanism configured to press the supporting member held through the opening of the holding member to fix the image carrier at a specific position, wherein the holding member has an opening having a V-shape.

2. The image forming apparatus of claim 1, further comprising:

an intermediate transfer member configured to receive the toner image from the image carrier and to transfer the toner image onto a recording medium.

3. An image forming apparatus, comprising:

a plurality of image carrier units configured to form toner images in a sequential manner, each of the plurality of image carrier units including an image carrier, and a supporting member configured to support the image carrier;

a position determining unit including a holding member having a plurality of openings for receiving the supporting members of the respective image carrier units, each one of the plurality of openings having a predetermined shape to sustain a weight of a corresponding one of the plurality of image carrier units through a corresponding one of the supporting members in a vertical direction and to grip the corresponding one of the supporting members in a horizontal direction; and a pressure mechanism configured to press the supporting members held through the plurality of openings of the holding member to fix the image carriers at respective specific positions, wherein the holding member has an opening having a V-shape.

4. The image forming apparatus of claim 3, wherein after forming the toner images, the plurality of image carrier units are further configured to transfer the toner images onto a recording medium in a manner sequentially overlaying one another at a position of the recording medium.

5. The image forming apparatus of claim 3, further comprising:

an intermediate transfer member configured to receive the toner images from the plurality of image carriers in a manner sequentially overlaying one another at a position of the intermediate transfer member, and to transfer the overlaid toner image onto a recording medium.

6. An image forming apparatus, comprising:

a plurality of image carrier units configured to form toner images in a sequential manner, each of the plurality of image carrier units including an image carrier, and a supporting member configured to support the image carrier;

a position determining unit including a holding member having a plurality of openings for receiving the supporting members of the respective image carrier units, each one of the plurality of openings having a predetermined shape to sustain a weight of a corresponding one of the plurality of image carrier units through a corresponding one of the supporting members in a vertical direction and to grip the corresponding one of the supporting members in a horizontal direction; and a pressure mechanism configured to press the supporting members held through the plurality of openings of the holding member to fix the image carriers at respective specific positions, wherein the pressure mechanism includes a plurality of pressure members, each provided at a position facing each of the supporting members supporting a corresponding one of the image carriers and configured to move between a non-pressing position at which the pressure member does not contact the corresponding supporting member and a pressing position at which the pressure member presses the corresponding supporting member to fix the corresponding image carrier unit supported by the corresponding supporting member at a corresponding one of the respective predetermined position;

a plurality of biasing members, each configured to exert a pressing force on a corresponding one of the plurality of pressure members in a moving direction of the corresponding pressure member towards the pressing position; and a slide member configured to movably support the plurality of pressure members and supported by the holding member in a manner movable between a primary position corresponding to the non-pressing position and a secondary position corresponding to the pressing position.

7. The image forming apparatus of claim 6, wherein the slide member includes a guide configured to guide the plurality of pressure members along respective passages between the non-pressing position and the pressing position, a plurality of stoppers, each configured to stop a corresponding one of the plurality of pressure members at the non-pressing position against the pressing force of a corresponding one of the plurality of biasing members when the slide member is at the primary position, wherein each of the plurality of pressure members includes a wedge portion facing a corresponding one of the supporting members supporting a corresponding one of the image carriers, and wherein the slide member, the plurality of pressure members, the plurality of biasing members, and the plurality of stoppers are configured such that when the slide member is at the primary position, each one of the plurality of pressure members biased by a corresponding one of the plurality of biasing members stops contacting a corresponding one of the supporting members by a corresponding one of the plurality of stoppers, when the slide member moves from the primary position towards the secondary position, each one of the plurality of pressure members moves along with the slide member, when the slide member moves between the primary position and the secondary position, the each one of the plurality of pressure members is stopped with the wedge portion being pressed into the space between the guide and the corresponding one of the supporting members, and when the slide member further moves towards the secondary position, each one of the plurality of pressure members is released from the corresponding one of the plurality of stoppers.

8. The image forming apparatus of claim 7, wherein the each one of the plurality of pressure members includes two distant edge portions formed in line in a longitudinal direction of the guide and facing a guide surface of the guide, and is moved along the guide such that the two distant edge portions are held in contact with the guide surface of the guide.

9. The image forming apparatus of claim 6, wherein the slide member includes a plurality of first locking portions, wherein each one of the plurality of pressure members further includes a hole provided at a position corresponding to a corresponding one of the plurality of first locking portions and having an area corresponding to a moving area between the non-pressing position and the pressing position, and a second locking portion provided at a position facing the corresponding one of the plurality of first locking portion, and wherein each one of the plurality of biasing members is mounted between the corresponding one of the plurality of first locking portions and a corresponding one of the plurality of second locking portions.

10. The image forming apparatus of claim 6, further comprising:

a cover member arranged at a position externally facing the holding member via the slide member; and a travel member configured to cause the slide member to travel between the primary position and the secondary position, the travel member including an operation member movably mounted on the cover member and configured to reciprocate in a predetermined direction, and a motion converter configured to convert a reciprocation motion of the operation member to a traveling motion of the slide member.

11. The image forming apparatus of claim 6, wherein the slide member includes engagement portions at one edge position, another edge position, and a middle position between the two edge positions for being engaged with the holding member.

12. The image forming apparatus of claim 6, wherein the holding member further includes a contour extraction portion extended wider than an area of the plurality of openings in a longitudinal direction around an area in a vicinity to the plurality of openings.

13. The image forming apparatus of claim 6, wherein the holding member further includes mounting holes relative to the image forming apparatus and is configured to swing at the mounting holes between open and closed positions relative to the image forming apparatus.

* * * * *